US009098038B2

(12) United States Patent
Iwai et al.

(10) Patent No.: US 9,098,038 B2
(45) Date of Patent: Aug. 4, 2015

(54) IMAGE FORMING APPARATUS, FIXING DEVICE, IMAGE FORMING METHOD, AND COMPUTER READABLE MEDIUM

(71) Applicant: FUJI XEROX CO., LTD., Minato-ku, Tokyo (JP)

(72) Inventors: Kiyoshi Iwai, Kanagawa (JP); Tsuyoshi Sunohara, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 113 days.

(21) Appl. No.: 13/753,970

(22) Filed: Jan. 30, 2013

(65) Prior Publication Data

US 2014/0010563 A1 Jan. 9, 2014

(30) Foreign Application Priority Data

Jul. 3, 2012 (JP) ..... 2012-149184

(51) Int. Cl.
*G03G 15/20* (2006.01)
*G03G 15/00* (2006.01)

(52) U.S. Cl.
CPC ..... *G03G 15/2085* (2013.01); *G03G 15/2028* (2013.01); *G03G 15/2053* (2013.01); *G03G 15/55* (2013.01); *G03G 2215/2035* (2013.01)

(58) Field of Classification Search
CPC ..... G03G 15/2085; G03G 15/55; G03G 15/2028; G03G 15/2053; G03G 2215/2035
USPC ..... 399/67
See application file for complete search history.

(56) References Cited

U.S. PATENT DOCUMENTS

2012/0237241 A1 * 9/2012 Sunohara et al. ..... 399/67

FOREIGN PATENT DOCUMENTS

| | | | |
|---|---|---|---|
| JP | 4-235574 A | | 8/1992 |
| JP | 11-344915 A | | 12/1999 |
| JP | 2002-311744 A | | 10/2002 |
| JP | 2010231102 A | * | 10/2010 |

OTHER PUBLICATIONS

English Translation to JP2010231102, Iwai, Kiyoshi, Oct. 14, 2010.*

* cited by examiner

*Primary Examiner* — Ryan Walsh
(74) *Attorney, Agent, or Firm* — Sughrue Mion, PLLC

(57) ABSTRACT

An image forming apparatus includes a fixing device, a number-of-revolutions determining unit, and a stopping unit. The fixing device includes a toner image forming unit that forms a toner image, a fixing member that fixes toner to a recording medium, a pressure member that conveys the recording medium, a driving unit that rotates the pressure member to allow the fixing member to perform slave rotation, and a number-of-revolutions sensing unit that senses the number of revolutions of the fixing member. The number-of-revolutions determining unit determines, based on the number of revolutions of the fixing member sensed by the number-of-revolutions sensing unit, the number of revolutions of the driving unit. The stopping unit stops the driving unit when the number of revolutions determined by the number-of-revolutions determining unit is not equal to a specific number of revolutions.

5 Claims, 11 Drawing Sheets

IMAGE FORMING APPARATUS, FIXING DEVICE, IMAGE FORMING METHOD, AND COMPUTER READABLE MEDIUM

CROSS-REFERENCE TO RELATED APPLICATIONS

This application is based on and claims priority under 35 USC 119 from Japanese Patent Application No. 2012-149184 filed Jul. 3, 2012.

BACKGROUND

Technical Field

The present invention relates to an image forming apparatus, a fixing device, an image forming method, and a computer readable medium.

SUMMARY

According to an aspect of the invention, there is provided an image forming apparatus including a fixing device, a number-of-revolutions determining unit, and a stopping unit. The fixing device includes a toner image forming unit that forms a toner image, a fixing member that fixes toner to a recording medium, a pressure member that conveys the recording medium in such a manner that the recoding medium is sandwiched between the fixing member and the pressure member, a driving unit that rotates the pressure member to allow the fixing member to perform slave rotation, and a number-of-revolutions sensing unit that senses the number of revolutions of the fixing member. The number-of-revolutions determining unit determines, based on the number of revolutions of the fixing member sensed by the number-of-revolutions sensing unit, the number of revolutions of the driving unit. The stopping unit stops the driving unit when the number of revolutions determined by the number-of-revolutions determining unit is not equal to a specific number of revolutions.

BRIEF DESCRIPTION OF THE DRAWINGS

Exemplary embodiments of the present invention will be described in detail based on the following figures, wherein.

DETAILED DESCRIPTION

Figure 1:
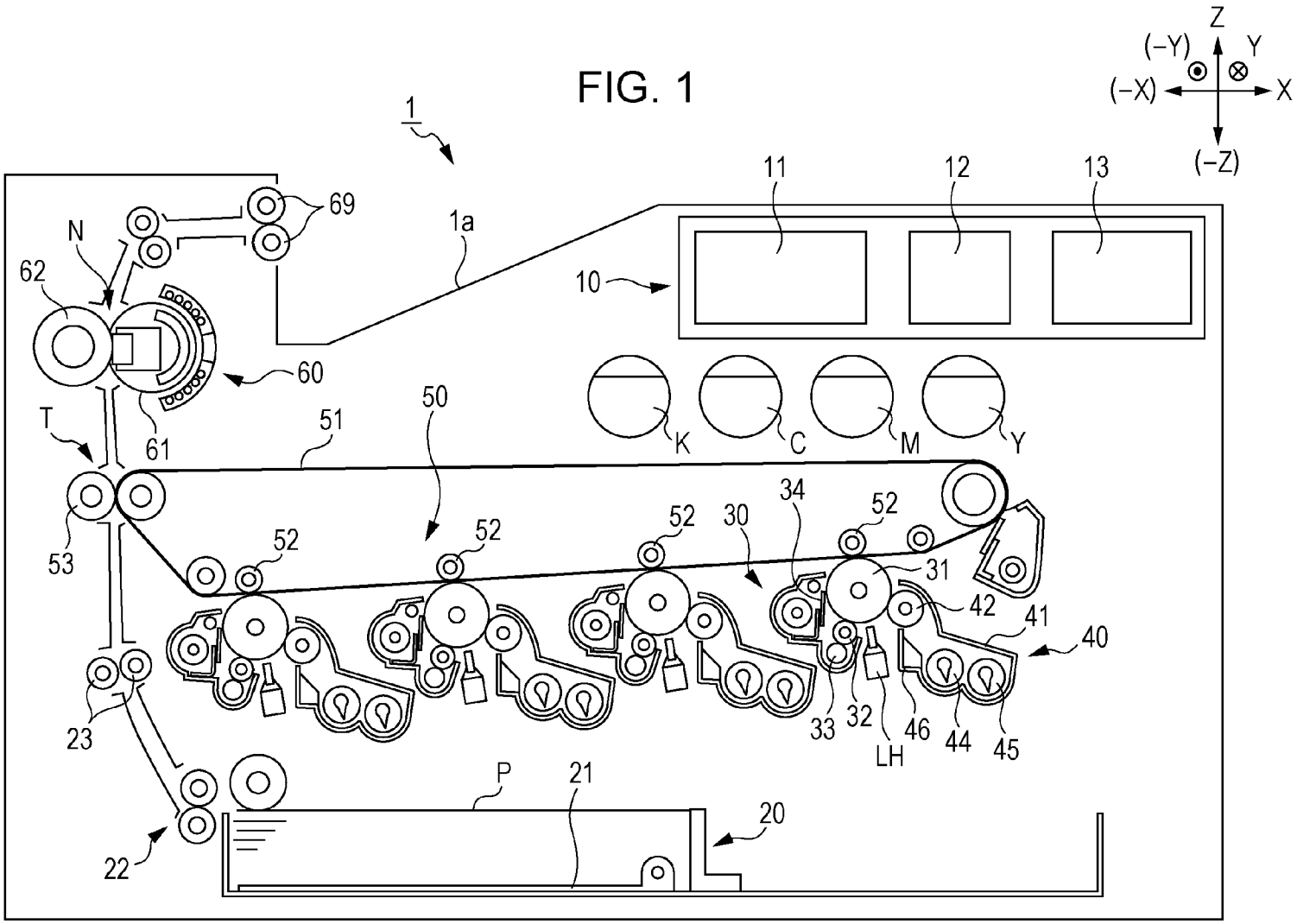
FIG. 1 is a schematic cross-sectional view illustrating the internal configuration of an image forming apparatus according to an exemplary embodiment.

Hereinafter, exemplary embodiments and specific examples of the present invention will be explained in detail with reference to the drawings. The present invention is not limited to the exemplary embodiments and specific examples described below.

Furthermore, in the explanation with reference to the drawings, it should be noted that the drawings are schematically represented and that the ratios of individual dimensions and the like differ from the actualities. For easier understanding, illustration of members not used in the explanation will be omitted in an appropriate manner.

For easier understanding of the explanation provided below, in the drawings, an X-axis direction defines the front-back direction, a Y-axis direction defines the left-right direction, and a Z-axis direction defines the up-down direction.

(1) Overall Configuration and Operation of Image Forming Apparatus

First Exemplary Embodiment

FIG. 1 is a schematic cross-sectional view illustrating the internal configuration of an image forming apparatus 1 according to a first exemplary embodiment. Hereinafter, the overall configuration and operation of the image forming apparatus 1 will be explained with reference to FIG. 1.

The image forming apparatus 1 includes a control device 10, a paper-feeding device 20, photoreceptor units 30, developing devices 40, a transfer device 50, and a fixing device 60. An ejection tray 1*a* is arranged on the upper surface (Z-direction) of the image forming apparatus 1. Paper is accommodated in the ejection tray 1*a* and paper on which images are recorded is ejected from the ejection tray 1*a*.

The control device 10 includes a controller 11, an image processing unit 12, a power supply device 13, and the like. The controller 11 controls the operation of the image forming apparatus 1. The operation of the image processing unit 12 is controlled by the controller 11. The power supply device 13 applies voltage to charging rollers 32, developing rollers 42, first transfer rollers 52, a secondary transfer roller 53, and the like, which will be described later.

The image processing unit 12 converts printing information received from an external information transmission device (for example, a personal computer or the like) into image information for forming a latent image, and outputs a driving signal to an exposure device LH at a specific time. The exposure device LH according to this exemplary embodiment includes a light emitting diode (LED) head in which LEDs are arranged linearly.

The paper-feeding device 20 is arranged at the bottom of the image forming apparatus 1. The paper-feeding device 20 includes a paper-loading plate 21. A large number of pieces of Paper P are loaded as recording media on the upper surface of the paper-loading plate 21. The paper P is loaded on the paper-loading plate 21 and the position of the paper P in the width direction is set by a regulation plate (not illustrated). The paper P is picked up, piece by piece, in the front direction (−X direction) from the top of the paper P by a paper pickup unit 22, and then is conveyed to a nip part of a pair of resist rollers 23.

The photoreceptor units 30 are arranged in parallel to one another above (in the Z direction) the paper-feeding device 20. The photoreceptor units 30 each include a photoreceptor drum 31 as an image carrier that is driven to rotate. The charging roller 32, the exposure device LH, the developing device 40, the first transfer roller 52, and a cleaning blade 34 are arranged along the direction of rotation of the photoreceptor drum 31. Cleaning rollers 33 that clean the surfaces of the individual charging rollers 32 are arranged in contact with the individual charging rollers 22.

The developing devices 40 each includes a developing housing 41 containing developer. In the developing housing 41, the developing roller 42 and a pair of augers 44 and 45 are arranged. The developing roller 42 faces the corresponding photoreceptor drum 31. The pair of augers 44 and 45 mix and convey the developer toward the corresponding developing roller 42. The pair of augers 44 and 45 is arranged diagonally below the back of the corresponding developing roller 42. Layer regulation members 46 that regulate the thickness of the layer of the developer are arranged in the vicinity of the individual developing rollers 42.

The developing devices 40 are configured similarly to one another with the exception of the developer accommodated in the developing housings 41, and form toner images of yellow (Y), magenta (M), cyan (C), and black (K).

The surfaces of the rotating photoreceptor drums 31 are charged by the charging rollers 32, and electrostatic latent images are formed by latent image forming light emitted from the exposure device LH. The electrostatic latent images formed on the photoreceptor drums 31 are developed as toner images by the developing rollers 42.

The transfer device 50 includes an intermediate transfer belt 51 and the first transfer rollers 52. Multiple transfer of toner images of individual colors formed on the photoreceptor drums 31 of the individual photoreceptor units 30 is performed on the intermediate transfer belt 51. The first transfer roller 52 sequentially transfers (first transfer) the toner images of individual colors formed by the photoreceptor units 30 to the intermediate transfer belt 51. The transfer device 50 also includes the secondary transfer roller 53 that collectively transfers (secondary transfer) to the paper P, which is a recording medium, the toner images of individual colors that have been transferred so as to be superimposed on the intermediate transfer belt 51.

The toner images of individual colors formed on the photoreceptor drums 31 of the individual photoreceptor units 30 are sequentially electrostatically transferred (first transfer) to the intermediate transfer belt 51 by the first transfer rollers 52 to which specific transfer voltage is applied from the power supply device 13 or the like controlled by the controller 11, and superimposed toner images obtained by superimposing the toner images of individual colors are formed.

The superimposed toner images on the intermediate transfer belt 51 are conveyed to a region (secondary transfer part T) in which the secondary transfer roller 53 is arranged, in accordance with movement of the intermediate transfer belt 51. At the time when the superimposed toner images are conveyed to the secondary transfer part T, the paper P is supplied from the paper-feeding device 20 to the secondary transfer part T. Specific transfer voltage is applied from the power supply device 13 or the like controller by the controller 11 to the secondary transfer roller 53, and the multiple toner images on the intermediate transfer belt 51 are collectively transferred to the paper P conveyed through the pair of resist rollers 23 and guided by a conveyer guide.

Residual toner on the surface of the photoreceptor drums 31 is removed by the cleaning blades 34 and is recovered into a waste toner container (not illustrated). The surfaces of the photoreceptor drums 31 are recharged by the charging rollers 32. Residuals that are not removed by the cleaning blades 34 and adhered to the charging rollers 32 are caught on the surfaces of the cleaning rollers 33, which rotate in contact with the charging rollers 32, and are accumulated on the cleaning rollers 33.

The fixing device 60 includes an endless fixing belt 61 and a pressure roller 62. The fixing belt 61 rotates in one direction. The pressure roller 62 rotates in one direction in contact with the peripheral surface of the fixing belt 61. A region where the fixing belt 61 and the pressure roller 62 are press-contacted forms a nip part N (fixing region).

The paper P to which a toner image is transferred by the transfer device 50 passes through the conveyer guide in a state where the toner image is not fixed, and is conveyed to the fixing device 60. Due to pressure-contact and heating, the toner image is fixed, by the pair of the fixing belt 61 and the pressure roller 62, to the paper P conveyed to the fixing device 60. The paper P on which the fixed toner image is formed is ejected from a pair of ejection rollers 69 to the ejection tray 1*a* on the upper surface of the image forming apparatus 1, with the guidance of the conveyer guide.

(2) Configuration of Fixing Device

Figure 2:
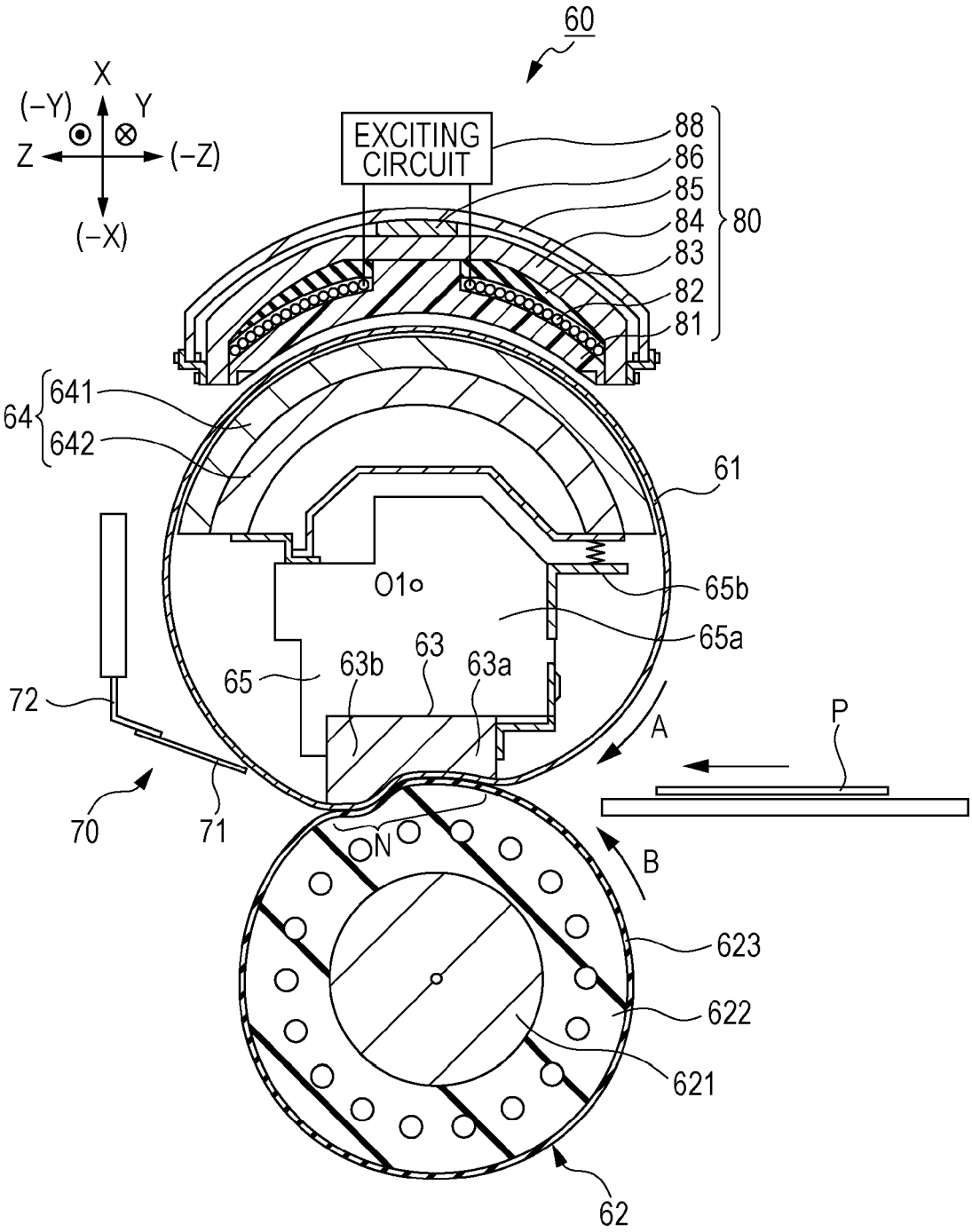
FIG. 2 is a schematic cross-sectional view of a fixing device according to an exemplary embodiment.
Figure 3:
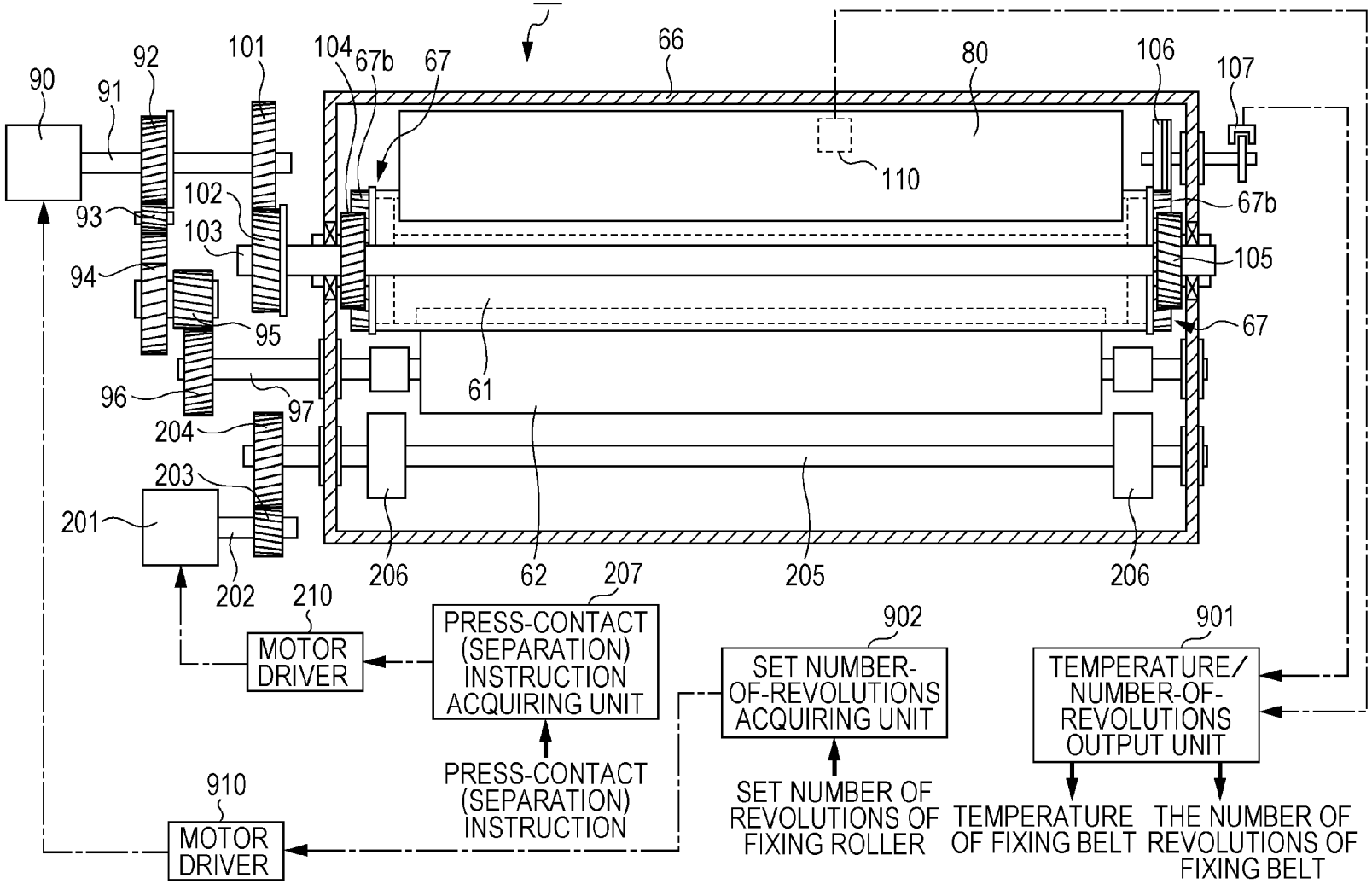
FIG. 3 is a schematic front view when viewed from a paper-conveying side of the fixing device according to the exemplary embodiment.

FIG. 2 is a schematic cross-sectional view of the fixing device 60 configuring a fixing unit of the image forming apparatus 1 according to this exemplary embodiment. FIG. 3 is a schematic front view of the fixing device 60 when viewed from a paper-conveying side thereof.

The fixing device 60 includes an induction heating (1H) heater 80, the fixing belt 61, and the pressure roller 62. The IH heater 80 is an example of a magnetic field generating member that generates an alternating-current magnetic field. The fixing belt 61 is an example of a fixing member that fixes a toner image by being electromagnetically induction-heated by the IH heater 80. The pressure roller 62 is an example of a pressure member arranged so as to face the fixing belt 61.

A pressure pad 63, a holder 65, and a heat conduction unit 64 are provided on the inner circumference side of the fixing belt 61. The pressure pad 63 forms the nip part N and is pressed by the pressure roller 62 via the fixing belt 61. The holder 65 is an example of a holding member that holds component members including the pressure pad 63. The heat conduction part 64 generates heat by electromagnetic induction by the alternating-current magnetic field generated by the IH heater 80.

Drive transmission members 67 are provided on both sides of the fixing belt 61. In order to rotate and drive the fixing belt 61, the drive transmission members 67 transmit rotational drive force for the fixing belt 61.

Furthermore, a separation aid member 70 is provided on the downstream side of the nip part N of the fixing belt 61 and the pressure roller 62 in the direction in which the paper P is conveyed. The separation aid member 70 aids separation of the paper P from the fixing belt 61.

(2.1) Fixing Belt

Figure 4:
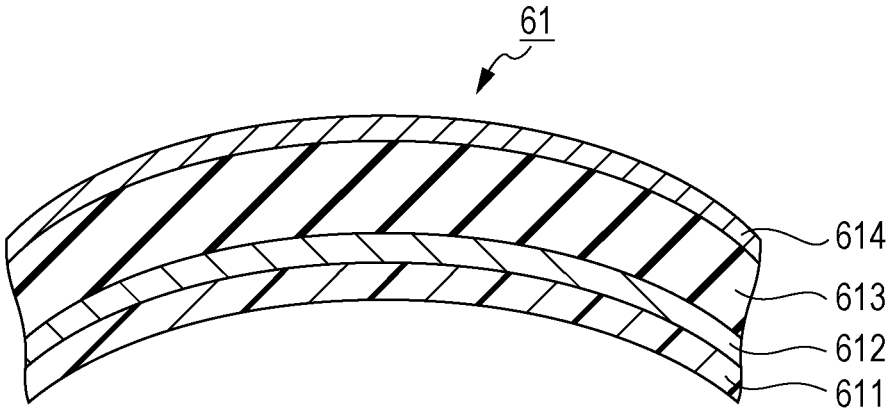
FIG. 4 is a schematic cross-sectional view of layers of a fixing belt forming the fixing device.

FIG. 4 is a schematic cross-sectional view of layers of the fixing belt 61 configuring the fixing device 60 according to this exemplary embodiment. Hereinafter, the fixing belt 61 will be explained with reference to FIGS. 2 to 4.

The fixing belt 61 is an endless belt member whose original shape is a cylindrical shape. For example, the original shape (cylindrical shape) has a diameter within a range between 20 mm and 50 mm and the length in a width direction of 370 mm. Furthermore, the fixing belt 61 is a belt member having a multilayer configuration including a substrate layer 611, a conductive heat-generating layer 612 stacked on the substrate layer 611, an elastic layer 613 that improves the fixity of toner images, and a surface release layer 614 provided as the uppermost layer.

The substrate layer 611 holds the conductive heat-generating layer 612, which is a thin layer, and is formed of a heat-resistant sheet-like member forming the mechanical strength of the entire fixing belt 61. Furthermore, the substrate layer 611 is made of a material and a thickness that achieve the physical characteristics (relative permeability and specific resistance) that allow a magnetic field to pass in such a manner that the alternating-current magnetic field generated by the IH heater 80 is applied to a temperature-sensitive magnetic member 641. Meanwhile, the substrate layer 611 itself does not generate heat or does not easily generate heat due to the magnetic field.

Specifically, for example, non-magnetic metal such as non-magnetic stainless steel of a thickness within a range between 30 μm and 200 μm, preferably a range between 50 μm and 150 μm, or a resin material (for example, a polyimide resin) of a thickness within a range between 50 μm and 200 μm is used as the material of the substrate layer 611.

The conductive heat-generating layer 612 is an example of a conductive layer. The conductive heat-generating layer 612 is an electromagnetic induction heat-generating layer that is electromagnetically induction-heated by the alternating-current magnetic field generated by the IH heater 80 and is a layer that generates eddy current when the alternating-current magnetic field from the IH heater 80 passes through the conductive heat-generating layer 612 in the thickness direction. The frequency of the alternating-current magnetic field generated by the IH heater 80 is, for example, equal to the frequency of an alternating current generated by a general-purpose power supply, that is, within a range between 20 kHz and 100 kHz. Thus, the conductive heat-generating layer 612 is configured in such a manner that an alternating-current magnetic field having a frequency within a range between 20 kHz and 100 kHz intrudes into and passes through the conductive heat-generating layer 612.

A region of the conductive heat-generating layer 612 into which an alternating-current magnetic field may intrude is defined as a "skin depth (δ)", which is a region where the alternating-current magnetic field is attenuated to 1/e, and is calculated from equation (1), where "f" represents the frequency of an alternating-current magnetic field (for example, 20 kHz), "ρ" represents a specific resistance (Ω≠m), and "μr" represents a relative permeability:

$$\delta=503(\rho/(f\times\mu r))^{1/2} \quad (1).$$

Thus, in order that the alternating-current magnetic field having a frequency within a range between 20 kHz and 100 kHz intrudes into and passes through the conductive heat-generating layer 612, the thickness of the conductive heat-generating layer 612 is configured to be thinner than the skin depth (δ) of the conductive heat-generating layer 612 defined by equation (1). Furthermore, for example, metal such as Au, Ag, Al, Cu, Zn, Sn, Pb, Bi, Be, Sb, or the like or a metallic alloy of the above-mentioned metals is used as a material of the conductive heat-generating layer 612.

Specifically, as the material of the conductive heat-generating layer 612, for example, non-magnetic metal (the relative permeability is approximately 1) such as Cu having a thickness within a range between 2 μm and 20 μm and a specific resistance of $2.7\times10^{-8}$ Ω·m or less is used.

In addition, from the point of view in which the time to be required for heating the fixing belt 61 up to a fixation set temperature (hereinafter, referred to as "warm-up time") is shortened, it is desirable to configure the conductive heat-generating layer 612 as a thin layer.

The elastic layer 613 is formed of a heat-resistant elastic body such as silicone rubber. A toner image, which is a fixing target and held on the paper P, is formed by stacking toner, which is powder, of individual colors. Thus, in order that heat is uniformly supplied over the entire toner image in the nip part N, it is desirable that the surface of the fixing belt 61 is deformed in accordance with the surface roughness of the toner image on the paper P. Thus, for example, silicone rubber having a thickness within a range between 100 μm and 600 μm and a hardness within a range between 10° and 30° (JIS-A) is suitably used as the elastic layer 613.

The surface release layer 614 is provided for weakening the adhesion force of toner melted on the paper P and allowing the paper P to be separated from the fixing belt 61 easily. For example, a layer formed of tetrafluoroethylene/perfluoroalkyl vinyl ether copolymer (PFA), polytetrafluoroethylene (PTFE), or silicone copolymer, or a layer formed of a composite of the above-mentioned materials may be used as the surface release layer 614. In consideration of the balance between abrasion resistance and heat capacity, it is desirable that the surface release layer 614 has a thickness within a range between 1 μm and 50 μm.

(2.2) Pressure Roller

The pressure roller 62 is formed by stacking, for example, a metallic cylindrical core 621, a heat-resistant elastic layer 622 (for example, a silicone rubber layer, a fluoro-rubber layer, or the like) formed on the outer circumference of the core 621, and if necessary, a separation layer 623 coated with, for example, a heat-resistant resin such as PFA or heat-resistant rubber.

The pressure roller 62 is pressed against the pressure pad 63 with the fixing belt 61 therebetween by a motion mechanism 200 and forms the nip part N. Furthermore, the pressure roller 62 is supported by the motion mechanism 200 so as to be in contact with or be separated from the outer circumference of the fixing belt 61. At the time of fixing operation, the pressure roller 62 rotates in the direction represented by arrow B in FIG. 2. By allowing the paper P holding an unfixed toner image to pass through the nip part N, the pressure roller 62 applies heat and pressure to the paper P and fixes the unfixed toner image to the paper P.

(2.3) Pressure Pad and Holder

The pressure pad 63 is pressed by the pressure roller 62 with the fixing belt 61 therebetween, and the pressure pad 63 and the pressure roller 62 form the nip part N.

The pressure pad 63 may be formed of any material as long as the deflection in the case of the combination of the pressure pad 63 and the holder 65 when compressive force is applied from the pressure roller 62 is smaller than or equal to a tolerance, specifically, smaller than or equal to 0.5 mm. For example, a heat-resistant resin such as an elastic body including silicone rubber and fluoro rubber, glass-fiber reinforced polyphenylene sulfide (PPS), phenol, polyimide, liquid crystal polymer, or the like may be used as the material of the pressure pad 63.

The holder 65 that holds the pressure pad 63 includes a holder body unit 65*a* and a spring member 65*b* that holds the temperature-sensitive magnetic member 641 and an inductive member 642 that form the heat conduction unit 64. The holder 65 maintains the uniformity of pressure in the longitudinal direction in the nip part N (nip pressure). Furthermore, since the fixing device 60 according to this exemplary embodiment adopts the configuration in which the fixing belt 61 is heated using electromagnetic induction, the holder body unit 65*a* is formed of a material that does not affect the induction field or that is less likely to affect the induction field and that is not affected by the induction field or that is less likely to be affected by the induction field. For example, a heat-resistant resin such as glass-fiber reinforced polyphenylene sulfide (PPS), a non-magnetic metallic material such as Al, Cu, or Ag, or the like is used as the material of the holder 65.

For the pressure pad 63, different nip pressures are set for a pre-nip region 63*a*, which is on the entry side of the nip part N (on the upstream side in the direction in which the paper P is conveyed), and a separation nip region 63*b*, which is an exit side of the nip part N (on the downstream side in the direction in which the paper P is conveyed).

That is, the surface of the pressure pad 63 near the pressure roller 62 in the pre-nip region 63*a* is formed in a circular arc shape approximately following the outer circumference of the pressure roller 62. Thus, a uniform and wide-width portion of the nip part N is formed. Furthermore, the separation nip region 63*b* is formed so as to be pressed by the surface of the pressure roller 62 with a locally large nip pressure in such a manner that the curvature radius of the fixing belt 61 passing through the separation nip region 63*b* is reduced.

Accordingly, a curl in the direction away from the surface of the fixing belt 61 is formed on the paper P passing through the separation nip region 63*b*, and separation of the paper P from the surface of the fixing belt 61 is urged.

(2.4) Separation Aid Unit

In this exemplary embodiment, as a separation aid unit by the pressure pad 63, the separation aid member 70 is provided on the downstream side of the nip part N. The separation aid member 70 is supported by a support plate 72 in a state in which a separation baffle 71 is close to the fixing belt 61 in the direction opposite the revolution motion of the fixing belt 61. By supporting the curl portion formed on the paper P by the separation baffle 71 at the exit of the pressure pad 63, moving of the paper P toward the fixing belt 61 is suppressed.

(2.5) IH heater

The IH heater 80 that causes an alternating-current magnetic field to be operated on the conductive heat-generating layer 612 of the fixing belt 61 and electromagnetically induction-heats the conductive heat-generating layer 612 will now be explained with reference to FIG. 2.

As illustrated in FIG. 2, the IH heater 80 is configured to be a shape following the outer circumference of the fixing belt 61 and is arranged so as to face the heat conduction unit 64 with the fixing belt 61 therebetween.

The IH heater 80 includes, for example, a supporter 81 that is formed of a non-magnetic body such as a heat-resistant resin, an exciting coil 82 that generates an alternating-current magnetic field, an elastic supporting member 83 that fixes the exciting coil 82 on the supporter 81, and a magnetic core 84 that forms plural magnetic paths for alternating-current magnetic fields generated by the exciting coil 82. The plural magnetic paths are arranged along the width direction of the fixing belt 61.

Furthermore, the IH heater 80 includes a shield 85 that shields a magnetic field, a pressure member 86 that pressurizes the magnetic core 84 toward the supporter 81, and an exciting circuit 88 that supplies alternating current (electric power) to the exciting coil 82.

The supporter 81 is formed in a shape in which the cross section of the supporter 81 follows the outer circumference of the fixing belt 61 and a specific gap (for example, within a range between 0.5 mm and 2 mm) is maintained between the supporter 81 and the outer circumference of the fixing belt 61.

For example, heat-resistant glass, a heat-resistant resin such as polycarbonate (PC), polyethersulfone (PES), or polyphenylene sulfide (PPS), or a heat-resistant non-magnetic material such as a heat-resistant resin obtained by mixing glass fiber with the above-mentioned heat-resistance resin may be used as the material of the supporter 81.

The exciting coil 82 is configured by wrapping Litz wire formed of, for example, 90 copper wire rods, which are insulated from one another and each have a diameter of, for example, 0.17 mm, in a cavity closed loop of an elliptical shape, an oval shape, rectangular shape, or the like. When alternating current within a range between 20 kHz and 100 kHz generated by a general-purpose power supply is supplied from the exciting circuit 88 to the exciting coil 82, an alternating-current magnetic field is generated around the exciting coil 82.

The elastic supporting member 83 is a sheet-like member formed of an elastic body such as, for example, silicone rubber or fluoro rubber. The elastic supporting member 83 is set in such a manner that the exciting coil 82 is pressed against the supporter 81 to fix the exciting coil 82 in close contact with a support surface 81*a* of the supporter 81.

The magnetic core 84 forms paths (magnetic paths) for magnetic field lines (magnetic flux) caused by the alternating-current magnetic field generated by the exciting coil 82. Along the magnetic paths, the magnetic field lines are induced inside the magnetic core 84, pass from the magnetic core 84 through the fixing belt 61 toward the temperature-sensitive magnetic member 641, and pass through the temperature-sensitive magnetic member 641 to return to the magnetic core 84. Accordingly, the magnetic field lines of the alternating-current magnetic field generated by the exciting coil 82 are collected at a region of the fixing belt 61 that faces the magnetic core 84.

It is desirable that the magnetic core 84 is used in a form that reduces eddy current loss (for example, shielding or dividing of a current path due to a slit or the like, bundling of thin plates, or the like). It is desirable that the magnetic core 84 is formed of a material having a small hysteresis loss. Specifically, for example, a circular arc-shaped ferromagnetic body formed of an oxide or an alloy material of high magnetic permeability, such as fired ferrite, a ferrite resin, an amorphous alloy, a permalloy, a temperature-sensitive magnetic alloy, or the like, is used as the magnetic core 84.

The length of the magnetic core 84 along the rotation direction of the fixing belt 61 is set to be shorter than the length of the temperature-sensitive magnetic member 641 along the rotation direction of the fixing belt 61. Accordingly, the amount of leakage of the magnetic field lines to a peripheral portion of the IH heater 80 is reduced, and the power factor is thus increased. Moreover, the electromagnetic induction toward the metallic materials forming the fixing unit is suppressed, and the heat-generating efficiency at the fixing belt 61 (the conductive heat-generating layer 612) increases.

(2.6)

The heat conduction unit 64 includes the temperature-sensitive magnetic member 641 and the inductive member 642 that are stacked in that order from the inner circumference of the fixing belt 61 toward a central axis O1 of the fixing belt 61. The heat conduction unit 64 is arranged without contact with the holder body unit 65*a* in such a manner that the fixing belt 61 is maintained in a cylindrical shape by the spring member 65*b* of the holder 65. The heat conduction unit 64 is also in contact with the inner circumference of the fixing belt 61 without pressure.

The temperature-sensitive magnetic member 641 is formed in a circular arc shape (circular arc-shaped part) following the inner circumference of the fixing belt 61. The temperature-sensitive magnetic member 641 is arranged in contact with the inner circumference of the fixing belt 61 and facing the IH heater 80 with the fixing belt 61 therebetween.

Furthermore, the temperature-sensitive magnetic member 641 is formed of a material whose "permeability change start temperature" (refer to later part of the description) at which the permeability of the magnetic properties drastically changes is equal to or higher than the fixation set temperature and whose permeability change start temperature is set within a temperature range lower than the heat-resistant temperatures of the elastic layer 613 and the surface release layer 614 of the fixing belt 61.

Figure 5A:
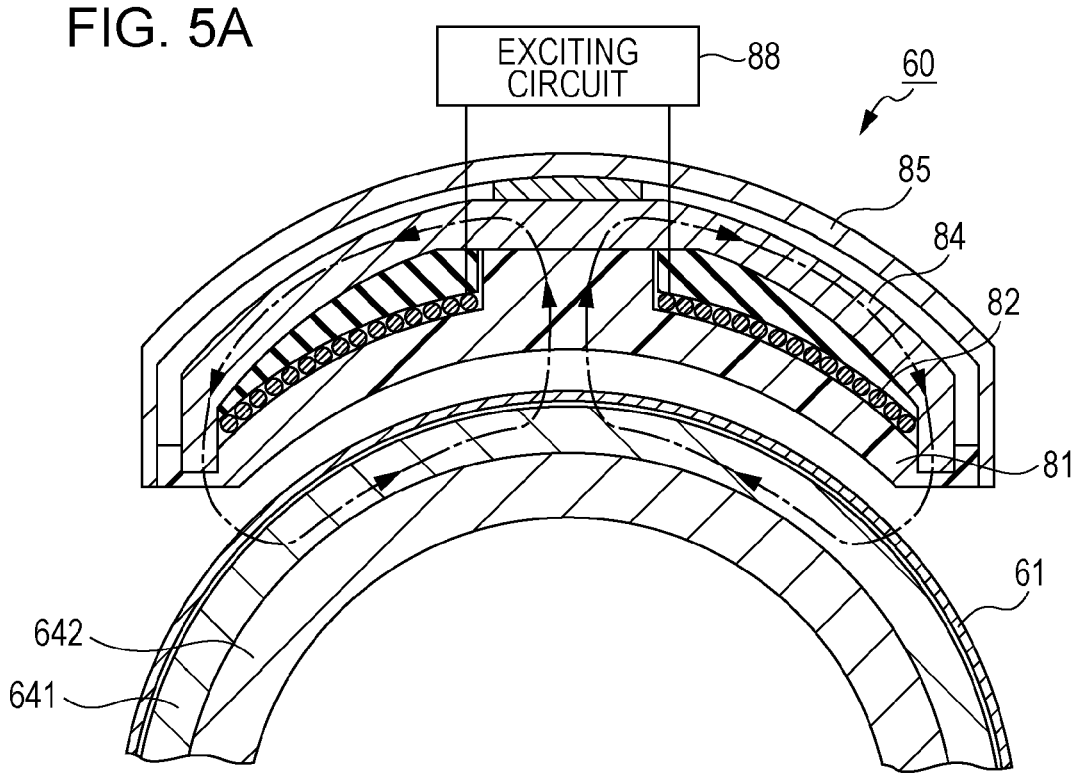
FIG. 5A is a schematic diagram for explaining an operation of a temperature-sensitive magnetic member in the case where the temperature of the fixing belt is lower than or equal to a permeability change start temperature.

Thus, in a temperature range not higher than the permeability change start temperature exhibiting ferromagnetic properties, the magnetic field lines generated by the IH heater 80 form magnetic paths extending through inside the temperature-sensitive magnetic member 641 along the shape of the temperature-sensitive magnetic member 641 (see FIG. 5A).

Figure 5B:
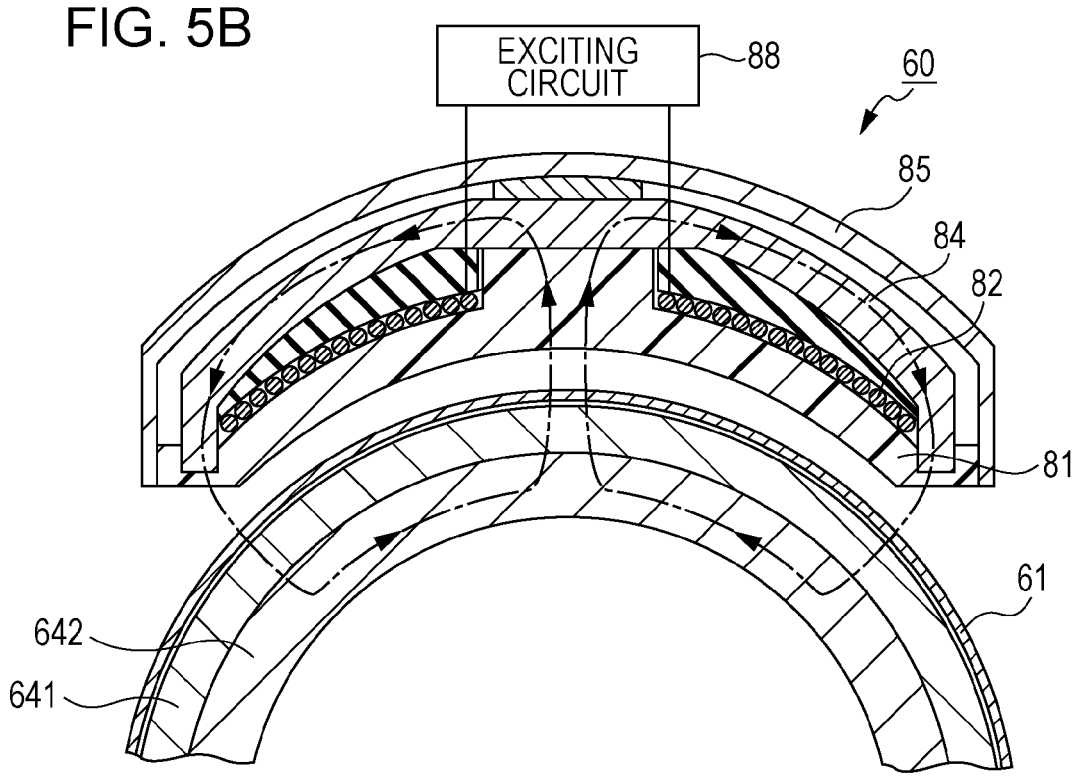
FIG. 5B is a schematic diagram for explaining an operation of the temperature-sensitive magnetic member in the case where the temperature of the fixing belt is higher than the permeability change start temperature.

Meanwhile, in a temperature range higher than the permeability change start temperature, the magnetic field lines generated by the IH heater 80 form magnetic paths extending through the temperature-sensitive magnetic member 641 in the thickness direction thereof, extending through inside the inductive member 642, and returning to the IH heater 80 (see FIG. 5B).

Here, the "permeability change start temperature" mentioned above refers to the temperature at which a permeability (permeability measured by JIS C2531, for example) starts decreasing continuously and is a temperature close to the Curie point, which is a temperature at which the magnetic properties are lost. However, the "permeability change start temperature" is a temperature having a concept different from the Curie point.

Specifically, for example, a binary temperature-sensitive magnetic alloy such as an Fe—Ni alloy (permalloy), a ternary temperature-sensitive magnetic alloy such as an Fe—Ni—Cr alloy, or the like whose permeability change start temperature is set within the range of the fixation set temperature (for example, between 140° C. and 240° C.) is used as the material of the temperature-sensitive magnetic member 641. The above-mentioned metallic alloys or the like including the permalloy and the temperature-sensitive magnetic alloy are suitable for the temperature-sensitive magnetic member 641 since they have excellent formability and workability and a high heat conductivity, with less expensive cost, and the like. Another example of the material includes a metallic alloy made of Fe, Ni, Si, B, Nb, Cu, Zr, Co, Cr, V, Mn, Mo, or the like.

In addition, the temperature-sensitive magnetic member 641 is formed with a thickness greater than the skin depth δ (see equation (1) described above) with respect to the alternating-current magnetic field (magnetic field lines) generated by the IH heater 80. Specifically, for example, in the case where an Fe—Ni alloy is used, the temperature-sensitive magnetic member 641 having a thickness of approximately 50 μm to 300 μm is used.

The inductive member 642 has a heat capacity greater than that of the fixing belt 61 and stores heat generated by the fixing belt 61 and the temperature-sensitive magnetic member 641. Thus, the inductive member 642 is formed of non-magnetic metal such as, for example, Ag, Cu, or Al having a relatively small specific resistance.

When the temperature of the temperature-sensitive magnetic member 641 increases to the permeability change start temperature or higher, the inductive member 642 induces the alternating-current magnetic field (magnetic lines) generated by the IH heater 80 and forms a state in which eddy current I is more likely to occur than the conductive heat-generating layer 612 of the fixing belt 61. Thus, the inductive member 642 is formed with a specific thickness (for example, 1.0 mm), which is sufficiently thicker than the skin depth δ (see equation (1) described above) so that the eddy current I may flow easily.

The case where the heat conduction unit 64 described above includes the temperature-sensitive magnetic member 641 and the inductive member 642 that are stacked in that order from the inner circumference side of the fixing belt 61 toward the central axis O1 and is arranged in contact with the inner circumference of the fixing belt 61 without pressure has been described. However, the temperature-sensitive magnetic member 641 may be arranged close to but without contact with the inner circumference of the fixing belt 61 with a specific gap (for example, between 0.5 mm and 1.5 mm) therebetween.

In the case where the temperature-sensitive magnetic member 641 is arranged close to but without contact with the inner circumference of the fixing belt 61, when the power of the image forming apparatus 1 is turned on and the fixing belt 61 is heated up to the specific fixation set temperature, heat of the fixing belt 61 is suppressed from flowing into the temperature-sensitive magnetic member 641, thus achieving shortening of the warm-up time.

(2.7) Driving Unit of Fixing Device

A drive mechanism of the pressure roller 62 and the fixing belt 61 in the fixing device 60 according to this exemplary embodiment will now be explained with reference to FIG. 3.

The fixing device 60 includes the motion mechanism 200. For the execution of fixation, the pressure roller 62 forms the nip part N by press-contacting the outer circumference of the fixing belt 61. For non-execution of fixation, the pressure roller 62 is supported by the motion mechanism 200 so as to be separated from the fixing belt 61.

During standby prior to the fixing operation, the pressure roller 62 is placed by the motion mechanism 200 at a warm-up position that is away from the fixing belt 61. At the warm-up position, the pressure roller 62 is in a state where the pressure roller 62 is not physically in contact with the fixing belt 61 (latch-off state).

As illustrated in FIG. 3, in the fixing device 60, rotational drive force from a drive motor 90 as an example of a driving unit is transmitted to a shaft 97 via a transmission gear 92 fixed to a rotation axis 91 and transmission gears 93, 94, 95 and 96. Accordingly, the pressure roller 62 is driven to rotate (see arrow B of FIG. 2).

Furthermore, the rotational drive force from the drive motor 90 is transmitted to a shaft 103 via a transmission gear 101 fixed to the rotation axis 91 coaxially with the transmission gear 92 and a one-way clutch 102 as an example of a rotational transmission restricting member. The rotational drive force is then transmitted from transmission gears 104 and 105 connected to the shaft 103 directly to gears 67*b* of the drive transmission members 67 arranged on both sides of the fixing belt 61 in the axis direction. Accordingly, the fixing belt 61 is driven to rotate (see arrow A of FIG. 2).

Then, at the time of the fixing operation, the fixing device 60 is in a state where the pressure roller 62 is in press-contact with the fixing belt 61 by the moving mechanism 200 (latch-on state). In the latch-on state, the one-way clutch 102 operates so that the transmission of the rotational drive force from the drive motor 90 to the shaft 97 stops. Then, when the pressure roller 62 is driven to rotate, the fixing belt 61 performs slave rotation following the revolution of the pressure roller 62.

(3) Effects and Advantages of Fixing Device (3.1) Operation of Fixing Device

The operation of the fixing device 60 according to this exemplary embodiment will now be explained.

In the fixing device 60, for example, a toner image forming operation in the image forming apparatus 1 starts, the drive transmission members 67 are driven to rotate by the drive motor 90 in the latch-off state where the fixing belt 61 is separated from the pressure roller 62, and the fixing belt 61 is driven to rotate in accordance with the revolution of the drive transmission members 67 (see arrow A of FIG. 2).

When the fixing belt 61 is driven to rotate, alternating current is supplied from the exciting circuit 88 to the exciting coil 82 forming the IH heater 80. When the alternating current is supplied to the exciting coil 82, generation and dissipation of magnetic flux (magnetic field) is repeated around the exciting coil 82. When the magnetic flux (magnetic field) passes through the temperature-sensitive magnetic member 641, eddy current is generated in the temperature-sensitive magnetic member 641 in such a manner that a magnetic field impedes the change in the magnetic field, and heat is generated in proportion to the skin resistance of the temperature-sensitive magnetic member 641 and the square of the magnitude of the current flowing in the temperature-sensitive magnetic member 641.

Here, the fixing belt 61 includes the conductive heat-generating layer 612 formed of non-magnetic metal (having a relative permeability of substantially equal to 1) such as Cu or the like. The magnetic flux (magnetic field) passes through the fixing belt 61, and the conductive heat-generating layer 612 is heated due to the operation of the magnetic flux (magnetic field).

The temperature-sensitive magnetic member 641 heats the fixing belt 61 while being rubbed against the inner circumference of the fixing belt 61. Accordingly, the fixing belt 61 is heated up to a set temperature (for example, 150° C.) in approximately ten seconds, for example.

Then, in the latch-on state where the pressure roller 62 is pressed against the fixing belt 61, the paper P delivered to the fixing device 60 is delivered to the nip part P between the fixing belt 61 and the pressure roller 62, and the paper P is heated and pressed by the fixing belt 61 heated by the temperature-sensitive magnetic member 641 and the pressure roller 62. Accordingly, a toner image is fixed to the surface of the paper P.

When the paper P is output from the nip part N of the fixing belt 61 and the pressure roller 62, the paper P is separated from the surface of the fixing belt 61.

(3.2) Effects of Fixing Device

Effects of the fixing device 60 according to this exemplary embodiment will be explained with reference to FIGS. 3, 6A, and 6B.

Figure 6A:
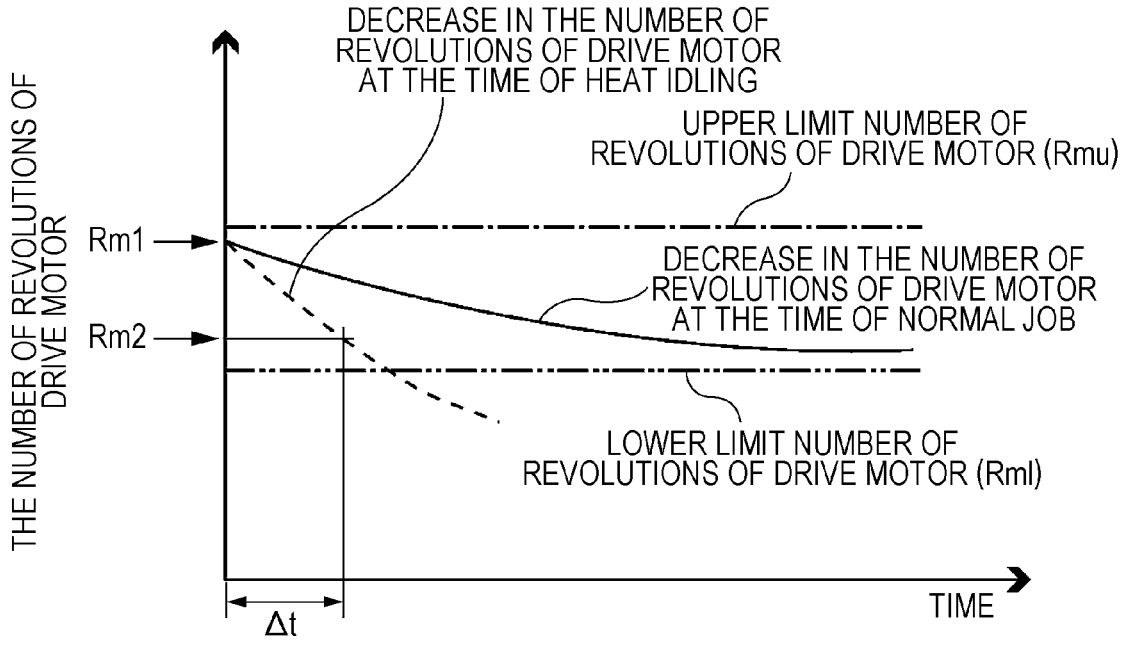
FIG. 6A is a schematic diagram for explaining a change in the number of revolutions of a drive motor controlled within a specific range at the time of a normal job.

FIG. 6A is a schematic diagram for explaining a change in the number of revolutions of the drive motor 90 controlled within a specific range at the time of a normal job.

The fixing device 60 according to this exemplary embodiment includes a temperature sensor 110, which is an example of a temperature sensing unit, facing the IH heater 80 inside the fixing belt 61, and senses the temperature of the fixing belt 61. The fixing device 60 also includes a revolution sensor 107, which is an example of a revolution sensing unit, and senses the number of revolutions of the fixing belt 61.

The temperature of the fixing belt 61 sensed by the temperature sensor 110 and the number of revolutions of the fixing belt 61 sensed by the revolution sensor 107 are output from a temperature/number-of-revolutions output unit 901 to a revolution controller 300 (see FIG. 7) provided in the control device 10 of the image forming apparatus 1 (see FIG. 1).

The fixing device 60 includes a set number-of-revolutions acquiring unit 902 for the drive motor 90. The fixing device 60 receives from the revolution controller 300 the set number of revolutions of the drive motor 90 determined on the basis of the number of revolutions of the fixing belt 61 and the temperature of the fixing belt 61 output from the temperature/number-of-revolutions output unit 901 and corresponding to the number of revolutions of the pressure roller 62.

The set number of revolutions of the drive motor 90 is transmitted from the set number-of-revolutions acquiring unit 902 to a motor driver 910. Accordingly, the revolution of the drive motor 90 is controlled by the motor driver 910.

The motion mechanism 200 includes a latch motor 201 serving as a driving source, a rotation axis 202, transmission gears 203 and 204, a shaft 205, and eccentric cams 206 provided at the shaft 205. The pressure roller 62 moves in the up-down direction (X direction) due to the revolution of the eccentric cams 206, and the pressure roller 62 operates to come into press-contact with the fixing belt 61 or to become separated from the fixing belt 61.

The motion mechanism 200 also includes a press-contact (separation) instruction acquiring unit 207. When receiving a press-contact (separation) instruction from the control device 10, the press-contact (separation) instruction acquiring unit 207 controls the operation of the latch motor 201 via a motor driver 210.

Here, since the pressure roller 62 includes the heat-resistant elastic layer 622 and the separation layer 623 coated with a heat-resistant resin or heat-resistant rubber that are stacked on the outer circumference of the core 621 as described above (see FIG. 2), the pressure roller 62 expands by heating.

Thus, in the case where the number of revolutions of the pressure roller 62 is constant, the linear speed of the outer circumference of the pressure roller 62 changes in accordance with a change in the outer diameter. As a result, in the latch-on state where the pressure roller 62 is in press-contact with the fixing belt 61, since the fixing belt 61 performs slave rotation following the rotational driving of the pressure roller 62, the revolution speed, that is, the number of revolutions of the fixing belt 61 changes.

Thus, the set number of revolutions of the drive motor 90 determined on the basis of the number of revolutions of the fixing belt 61 and the temperature of the fixing belt 61 and corresponding to the number of revolutions of the pressure roller 62 is transmitted from the revolution controller 300 via the set number-of-revolutions acquiring unit 902 to the motor driver 910, and the revolution of the drive motor 90 is controlled by the motor driver 910. As a result, for a normal job, the revolution of the drive motor 90 is maintained within a specific range (see FIG. 6A).

Meanwhile, for example, in a setup cycle of the image forming apparatus 1 during a print job and in image information conversion processing, pre-processing of image forming operation, and post-processing of image forming operation in the image processing unit 12, when rotation continues in a state where the paper P does not pass through the nip part N of the fixing device 60 (hereinafter, referred to as "heat idling"), the quantity of heat is not drawn from the paper P and heat is directly transmitted from the fixing belt 61, which is controlled to be a specific high temperature, to the pressure roller 62. Thus, compared to the case of a normal job, the temperature of the pressure roller 62 excessively increases.

In this state, when the paper P to which a toner image is transferred by the transfer device 50 is delivered to the nip part N of the fixing device 60, part of toner on the paper P is transferred to the surface of the fixing belt 61 (hot offset), and the hot-offset toner is accumulated on the surface of the pressure roller 62 due to the subsequent revolution of a pair of the fixing belt 61 and the pressure roller 62. If the image forming apparatus 1 continues to be used in this state, the toner accumulated on the surface of the pressure roller 62 adheres to the front and back surfaces of the paper P. Thus, the image quality may be degraded.

At the time of heat idling, the quantity of heat is stored in the pressure roller 62. Thus, due to heat expansion, the outer diameter of the pressure roller 62 becomes larger than the case of a normal job, and the linear speed of the pressure roller 62 increases. As a result, the number of revolutions of the fixing belt 61 sensed by the revolution sensor 107 is greater than that for a normal job.

Thus, the revolution controller 300 decreases the set number of revolutions of the pressure roller 62 compared to the case of a normal job. A new set number of revolutions of the drive motor 90 is transmitted to the motor driver 910, and the number of revolutions of the drive motor 90 decreases (see FIG. 6A).

Furthermore, the image forming apparatus 1 according to this exemplary embodiment includes a calculating unit that calculates the decrease rate of the number of revolutions of the drive motor 90, and the current decrease rate of the number of revolutions of the drive motor 90 is compared with a predetermined decrease rate of the number of revolutions of the drive motor 90 for a normal job.

When it is determined that the current decrease rate of the number of revolutions of the drive motor 90 is greater than the predetermined decrease rate of the number of revolutions (heat idling), the control device 10 transmits a separation instruction to the press-contact (separation) instruction acquiring unit 207 of the motion mechanism 200. Upon receiving the separation instruction, the press-contact (separation) instruction acquiring unit 207 controls the driving of the latch motor 201 via the motor driver 210.

That is, the pressure roller 62 is placed at the warm-up position that is away from the fixing belt 61 by the motion mechanism 200, and the pressure roller 62 enters the latch-off state where the pressure roller 62 is not physically in contact with the fixing belt 61.

Then, heat transition from the fixing belt 61 to the pressure roller 62 stops, and an excessive increase in the temperature of the pressure roller 62 is suppressed.

(3.3) Control and Operation of Image Forming Apparatus and Fixing Device

Hereinafter, the control and operation of the image forming apparatus 1 and the fixing device 60 according to this exemplary embodiment will be explained in detail with reference to FIGS. 7 and 8.

Figure 7:
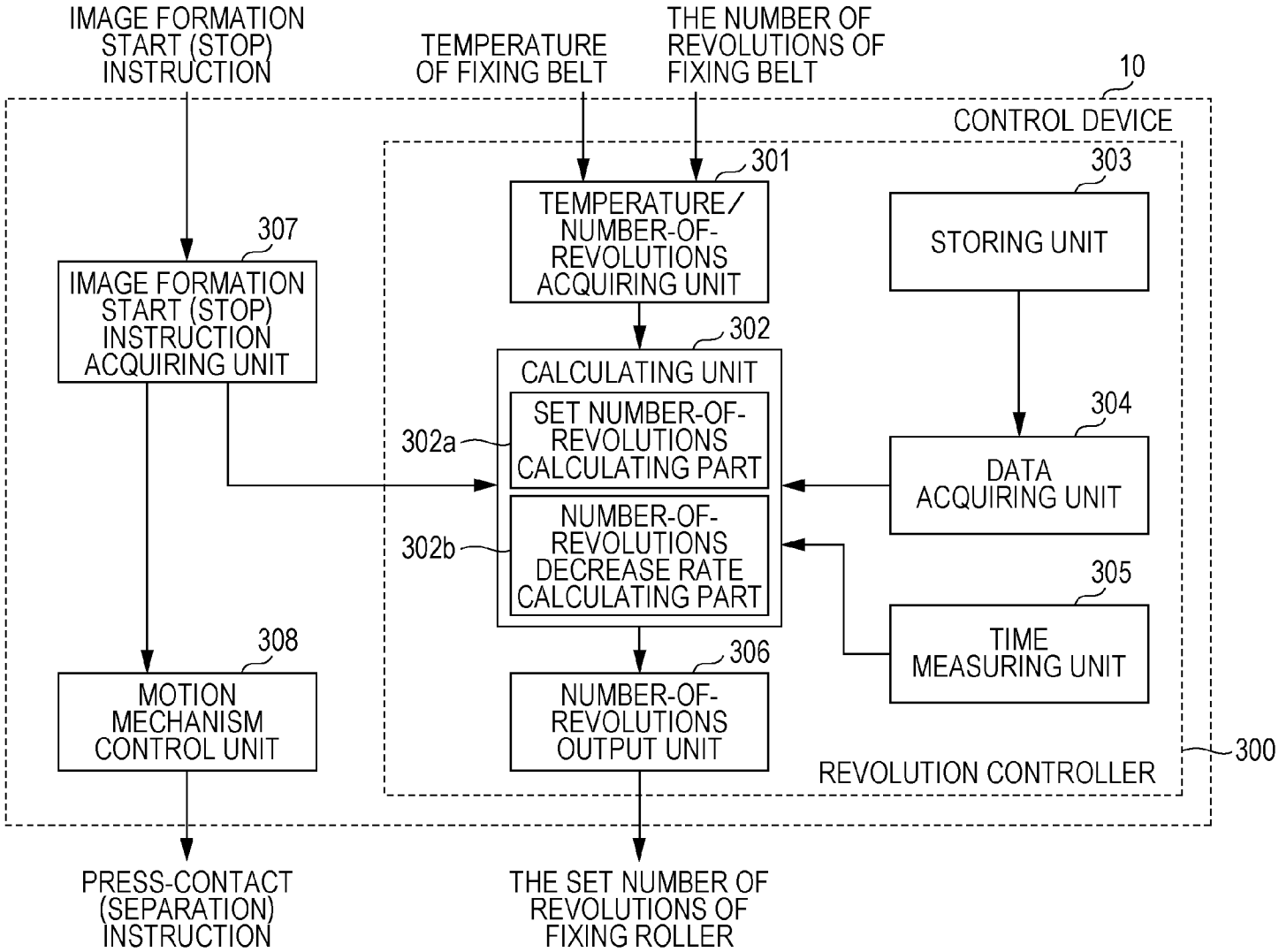
FIG. 7 is a block diagram for explaining a revolution controller of an image forming apparatus according to a first exemplary embodiment.
Figure 8:
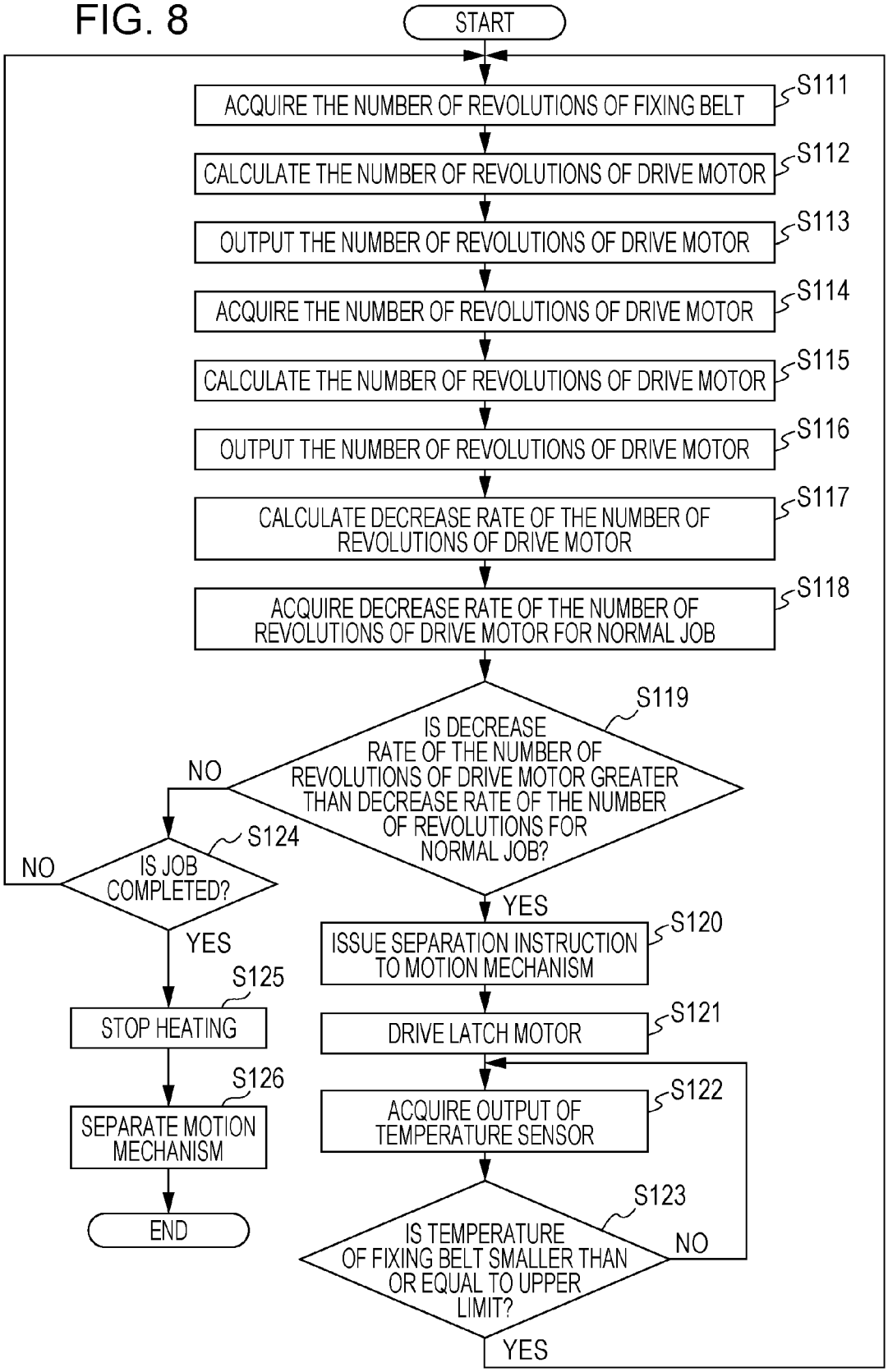
FIG. 8 is a flowchart for explaining the flow of a process performed by the revolution controller of the image forming apparatus according to the first exemplary embodiment.

FIG. 7 is a block diagram for explaining the revolution controller 300 that controls the fixing belt 61 to rotate at a specific number of revolutions even in the case where the outer diameter of the pressure roller 62 changes due to a change in the temperature of the pressure roller 62. FIG. 8 is a flowchart for explaining the flow of the process performed by the revolution controller 300.

In this exemplary embodiment, the revolution controller 300 forms part of the control device 10 that controls the entire image forming apparatus 1.

A temperature/number-of-revolutions acquiring unit 301 acquires the temperature and the number of revolutions of the fixing belt 61 from the temperature/number-of-revolutions output unit 901 of the fixing device 60.

A calculating unit 302 includes a set number-of-revolutions calculating part 302*a* and a number-of-revolutions decrease rate calculating part 302*b*. The set number-of-revolutions calculating part 302*a* calculates, on the basis of the temperature and the number of revolutions of the fixing belt 61 acquired via the temperature/number-of-revolutions acquiring unit 301, the set number of revolutions of the drive motor 90 determined for controlling the number of revolutions of the fixing belt 61 to be a specific number of revolutions and corresponding to the number of revolutions of the pressure roller 62.

The number-of-revolutions decrease rate calculating part 302*b* calculates the decrease rate of the number of revolutions of the drive motor 90, and compares the calculated decrease rate of the number of revolutions of the drive motor 90 with a predetermined decrease rate of the number of revolutions of the drive motor 90 for a normal job.

A storing unit 303 stores data to be used by the calculating unit 302.

A data acquiring unit 304 acquires data stored in the storing unit 303, and a time measuring unit 305 measures a point in time at which the revolution controller 300 performs specific control.

A number-of-revolutions output unit 306 outputs to the set number-of-revolutions acquiring unit 902 of the fixing device 60 the set number of revolutions of the pressure roller 62 calculated by the set number-of-revolutions calculating part 302*a*.

Furthermore, the control device 10 includes an image formation start (stop) instruction acquiring unit 307 and a motion mechanism control unit 308. The image formation start (stop) instruction acquiring unit 307 acquires an instruction for starting or stopping image formation. The motion mechanism control unit 308 controls the motion mechanism 200 of the pressure roller 62 and outputs to the press-contact (separation) instruction acquiring unit 207 of the fixing device 60 a press-contact (separation) instruction for the pressure roller 62.

The revolution controller 300 performs control for suppressing the number of revolutions of the fixing belt 61 from being unstable even when the outer diameter of the pressure roller 62 changes due to a change in the temperature of the pressure roller 62 during running of the fixing device 60.

Specifically, the revolution controller 300 gradually decreases the number of revolutions of the drive motor 90 corresponding to the number of revolutions of the pressure roller 62 and controls the number of revolutions of the drive motor 90 to fall within a normal range (see FIG. 7A).

Meanwhile, normally, the temperature inside the fixing device 60 does not increase to a certain temperature or more and the temperature of the pressure roller 62 also does not increase to a certain temperature or more. Thus, there is the upper limit of the increase in the outer diameter of the pressure roller 62 caused by heat expansion.

Thus, there is the minimum value of the number of revolutions of the drive motor 90 corresponding to the upper outer diameter of the pressure roller 62, that is, the lower limit number of revolutions. The lower limit number of revolutions (Rml) is defined corresponding to the value of the diameter of the pressure roller 62 increasing by heat expansion and is stored in the storing unit 303.

Furthermore, the maximum value of the number of revolutions of the drive motor 90, that is, the upper limit number of revolutions (Rmu), is defined in accordance with the printing speed of the image forming apparatus 1 within a range in which desired fixation processing is performed and is stored in the normal object 202.

The temperature/number-of-revolutions acquiring unit 301 of the revolution controller 300 acquires the current number of revolutions of the fixing belt 61 as a signal of the revolution sensor 107 from the temperature/number-of-revolutions output unit 901 of the fixing device 60 (step S111), and stores the acquired current number of revolutions of the fixing belt 61 as a first number of revolutions (Rb1) into the storing unit 303.

Then, the set number-of-revolutions calculating part 302*a* calculates, on the basis of the first number of revolutions (Rb1) of the fixing belt 61, the number of revolutions of the drive motor 90 for controlling the number of revolutions of the fixing belt 61 to be a predetermined specific number of revolutions, and stores the number of revolutions of the drive motor 90 as a first number of revolutions (Rm1) of the drive motor 90 into the storing unit 303 (step S112).

The first number of revolutions (Rm1) of the drive motor 90 is transmitted via the set number-of-revolutions acquiring unit 902 to the motor driver 910, and the motor driver 910 controls the revolution of the drive motor 90 (step S113).

Then, the temperature/number-of-revolutions acquiring unit 301 acquires the current number of revolutions of the fixing belt 61 at a specific sampling period (Δt: in this exemplary embodiment, for example, 20 milliseconds) based on the time measuring unit 305 (step S114), and stores the acquired current number of revolutions of the fixing belt 61 as a second number of revolutions (Rb2) into the storing unit 303.

Then, the set number-of-revolutions calculating part 302*a* calculates, on the basis of the second number of revolutions (Rb2) of the fixing belt 61, the number of revolutions of the drive motor 90 for controlling the number of revolutions of the fixing belt 61 to be a predetermined specific number of revolutions, and stores the calculated number of revolutions of the drive motor 90 as a second number of revolutions (Rm2) into the storing unit 303 (step S115).

The second number of revolutions (Rm2) of the drive motor 90 is transmitted via the set number-of-revolutions acquiring unit 902 to the motor driver 910, and the motor driver 910 controls the revolution of the drive motor 90 (step S116).

Then, the number-of-revolutions decrease rate calculating part 302*b* acquires, via the data acquiring unit 304, the first number of revolutions (Rm1) and the second number of revolutions (Rm2) of the drive motor 90 stored in the storing unit 303, and calculates, on the basis of a difference between the first number of revolutions (Rm1) and the second number of revolutions (Rm2), the decrease rate of the number of revolutions (DRm1) of the drive motor 90 for the sampling period (Δt) (step S117).

Furthermore, the number-of-revolutions decrease rate calculating part 302*b* acquires, via the data acquiring unit 304, a predetermined decrease rate of the number of revolutions (DRm0) of the drive motor 90 for a normal job stored in the storing unit 303 (step S118).

Then, the number-of-revolutions decrease rate calculating part 302*b* compares the decrease rate of the number of revolutions (DRm1) of the drive motor 90 calculated in step S117 with the decrease rate of the number of revolutions (DRm0) of the drive motor 90 for a normal job acquired in step S118 (step S119).

When the calculated decrease rate of the number of revolutions (DRm1) of the drive motor 90 is greater than the predetermined decrease rate of the number of revolutions (DRm0) of the drive motor 90 for a normal job (YES in step S119), it is determined that heat idling occurs. The motion mechanism control unit 308 transmits a separation instruction to the press-contact (separation) instruction acquiring unit 207 of the motion mechanism 200 (step S120).

Upon receiving the separation instruction, the press-contact (separation) instruction acquiring unit 207 controls driving of the latch motor 201 via the motor driver 210 (step S121).

That is, the pressure roller 62 is placed at the warm-up position that is away from the fixing belt 61 by the motion mechanism 200, and the pressure roller 62 enters the latch-off state where the pressure roller 62 is not physically in contact with the fixing belt 61.

Then, the temperature/number-of-revolutions acquiring unit 301 of the revolution controller 300 acquires, as a signal of the temperature sensor 110, the current temperature (T1) of the fixing belt 61 from the temperature/number-of-revolutions output unit 901 of the fixing device 60 (step S122), and the current temperature (T1) of the fixing belt 61 is stored into the storing unit 303.

The calculating unit 302 compares the current temperature (T1) of the fixing belt 61 with a predetermined set upper limit temperature (T0) of the fixing belt 61 (step S123). When the current temperature (T1) is higher the predetermined set upper limit temperature (T0) (NO in step S123), the latch-off state is maintained. When the current temperature (T1) is lower than or equal to the predetermined set upper limit temperature (T0), the fixing operation continues to be performed until the print job is completed.

When the calculated decrease rate of the number of revolutions (DRm1) of the drive motor 90 is smaller than or equal to the predetermined decrease rate of the number of revolutions (DRm0) of the drive motor 90 for a normal job (NO in step S119), it is determined that a normal job is being performed. The fixing operation continues to be performed until the print job is completed.

By the above-described series of control operations, in the case where at the time of heat idling the temperature of the pressure roller 62 excessively increases compared to the case of a normal job, the pressure roller 62 is placed at the warm-up position that is away from the fixing belt 61 by the motion mechanism 200. Thus, unnecessary heat transition to the pressure roller 62 is suppressed.

Consequently, wasteful energy consumption of the image forming apparatus 1 is suppressed, and hot offset and accumulation of toner on the surface of the pressure roller 62 are prevented.

Variation of First Exemplary Embodiment

Figure 9:
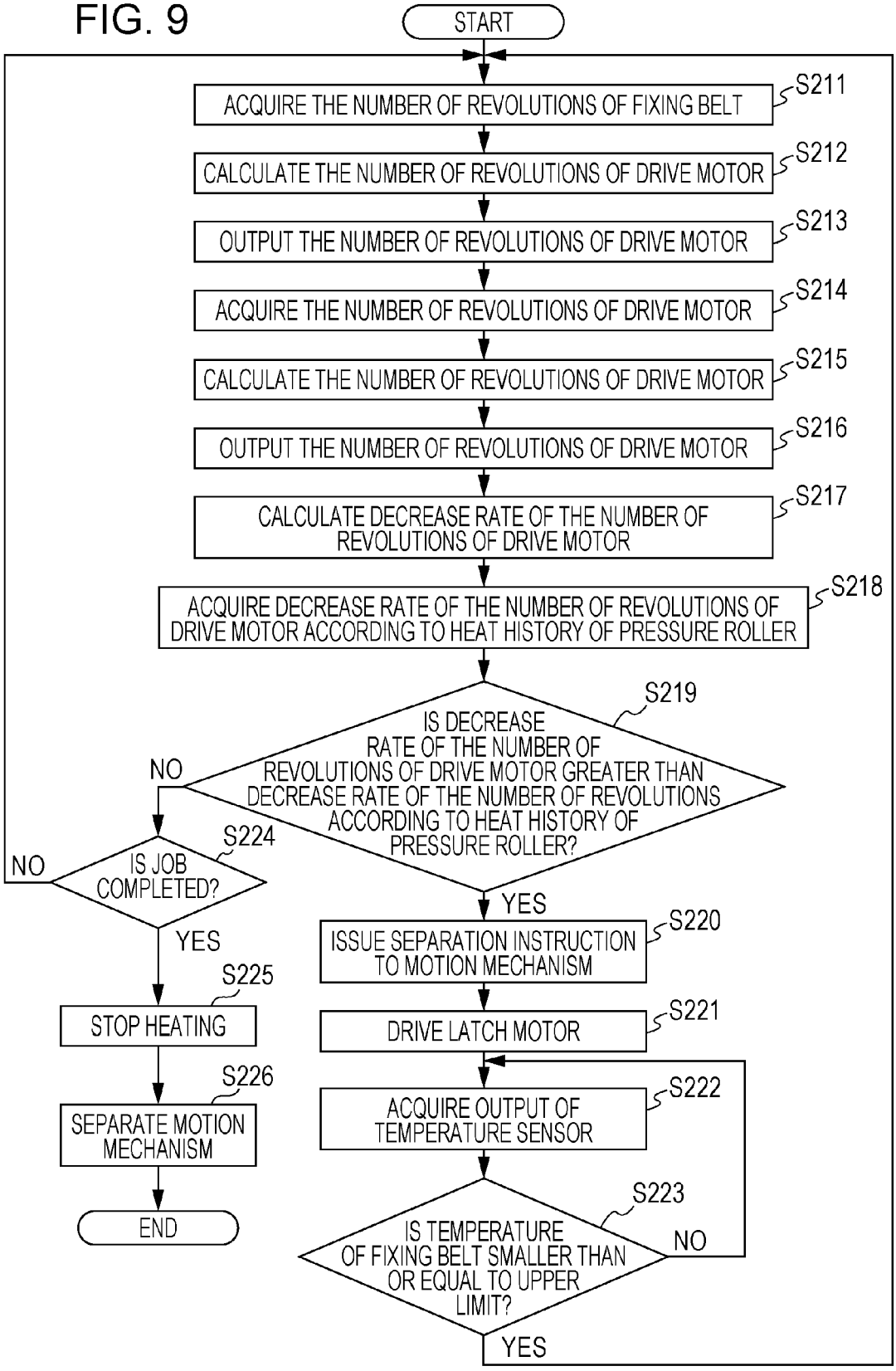
FIG. 9 is a flowchart for explaining a variation of the process performed by the revolution controller of the image forming apparatus according to the first exemplary embodiment.

FIG. 9 is a flowchart for explaining a variation of the operation performed by the revolution controller 300 of the image forming apparatus 1 according to the first exemplary embodiment.

The predetermined decrease rate of the number of revolutions of the drive motor 90, which is stored in the storing unit 303 and is referred to when the number-of-revolutions decrease rate calculating part 302*b* makes a determination as to heat idling, may be set in accordance with heat history received by the pressure roller 62.

Different heat histories are received by the pressure roller 62 in accordance with the history of print jobs, for example, the number of pieces of paper handled in the previous job and a the downtime between plural print jobs.

For example, when fixation of a large number of pieces of paper is continuously performed in the previous job, although the outer diameter of the fixing belt 61 changes little due to a small heat capacity, the outer diameter of the pressure roller 62 increases due to heat expansion.

Furthermore, in the case where a print job starts after a certain period of time has passed since the previous print job, the outer diameter of the pressure roller 62 after heat expansion differs according to the heat idling time.

Plural predetermined decrease rates of the number of revolutions (DRpn: n represents a natural number) of the drive motor 90 corresponding to the outer diameter of the pressure roller 62 are stored in the storing unit 303 in accordance with the heat history received by the pressure roller 62.

The number-of-revolutions decrease rate calculating part 302*b* calculates the decrease rate of the number of revolutions (DRm1) of the drive motor 90 for a sampling period (step S217), and acquires, via the data acquiring unit 304, plural decrease rates of the number of revolutions (DRmn: n represents a natural number) of the drive motor 90 corresponding to the heat history received by the pressure roller 62 and stored in the storing unit 303 (step S218).

Then, the number-of-revolutions decrease rate calculating part 302*b* compares the decrease rate of the number of revolutions (DRm1) of the drive motor 90 calculated in step S217 with the predetermined plural decrease rates of the number of revolutions (DRmn: n represents a natural number) of the drive motor 90 corresponding to the outer diameter of the pressure roller 62 (step S219).

When the calculated decrease rate of the number of revolutions (DRm1) is greater than any one of the predetermined plural decrease rates of the number of revolutions (DRmn: n represents a natural number) of the drive motor 90 corresponding to the outer diameter of the pressure roller 62 (YES in step S219), the motion mechanism control unit 308 transmits a separation instruction to the press-contact (separation) instruction acquiring unit 207 of the motion mechanism 200 (step S220).

Upon receiving the separation instruction, the press-contact (separation) instruction acquiring unit 207 controls driving of the latch motor 201 via the motor driver 210 (step S221).

That is, the pressure roller 62 is placed at the warm-up position that is away from the fixing belt 61 by the motion mechanism 200, and the pressure roller 62 enters the latch-off state where the pressure roller 62 is not physically in contact with the fixing belt 61. The control device 10 maintains the latch-off state until the next paper feeding instruction is input.

By the control described above, the pressure roller 62 is placed at the warm-up position that is away from the fixing belt 61 by the motion mechanism 200 in accordance with print job history of the image forming apparatus 1, and unnecessary heat transition to the pressure roller 62 is suppressed.

Consequently, wasteful energy consumption of the image forming apparatus 1 is suppressed, and hot offset and accumulation of toner on the surface of the pressure roller 62 are prevented.

Second Embodiment

The configuration of an image forming apparatus 1A according to a second exemplary embodiment is the same as that of the image forming apparatus 1 according to the first exemplary embodiment with the exception in that the revolution controller 300 detects wrapping of paper and notifies a user of the image forming apparatus 1A of the wrapping of the paper. Thus, the component parts common between the image forming apparatus 1 according to the first exemplary embodiment and the image forming apparatus 1A according to the second exemplary embodiment are referred to with the same reference numerals and the detailed explanation thereof will be omitted.

Figure 6B:
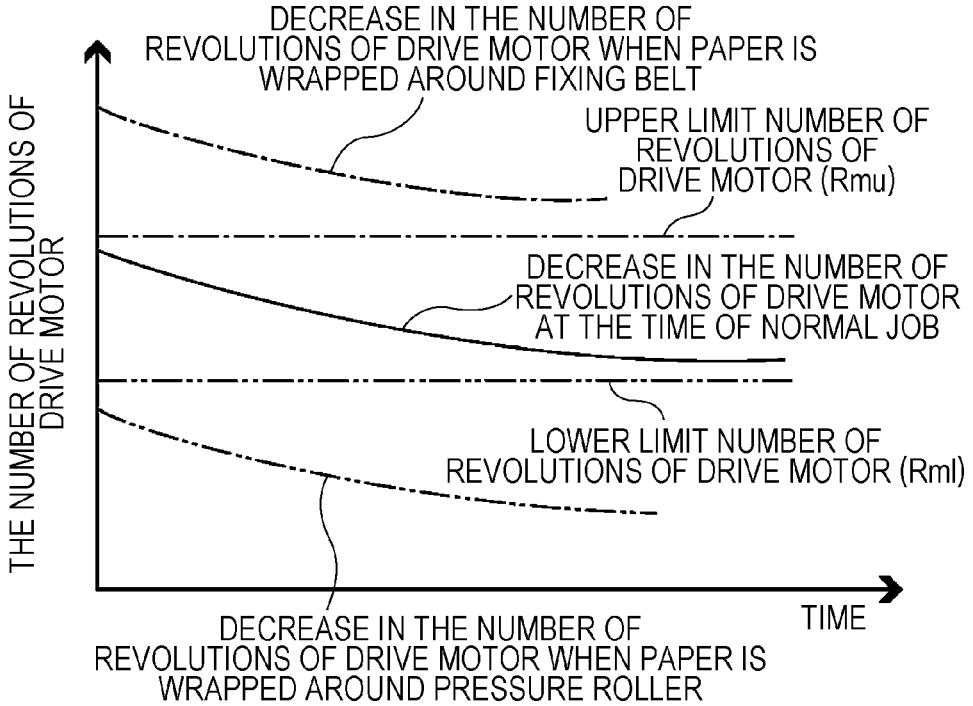
FIG. 6B is a schematic diagram illustrating a change in the number of revolutions of the drive motor in the case where paper is wrapped around the fixing belt or a pressure roller.

FIG. 6B is a schematic diagram illustrating a change in the number of revolutions of the drive motor 90 in the case where the paper P is wrapped around the fixing belt 61 or the pressure roller 62.

Here, the paper P may be wrapped around the pressure roller 62 during a fixing operation of the fixing device 60. Since the fixing device 60 includes the temperature sensor 110 on the inner circumference of the fixing belt 61 and detects the temperature of the fixing belt 61, for example, in the case where the paper P is wrapped around the surface of the fixing belt 61, the fixing device 60 does not determine as to wrapping of the paper P.

Meanwhile, in the case where the paper P is wrapped around the pressure roller 62, in general, the fixing device 60 is capable of continuing to perform fixation even if the paper P is not removed.

Thus, when the paper P is wrapped around the surface of the fixing belt 61 or the pressure roller 62, surface roughness on the paper P, which is caused by the wrapping of the paper P, causes a disturbance in a fixed image. Furthermore, paper wrinkle or abnormal sound may be generated. Thus, in the case where the paper P is wrapped around the fixing belt 61 or the pressure roller 62, measures for quickly detecting the wrapping of the paper P, stopping the image forming apparatus 1A, issuing a warning to the user of the image forming apparatus 1A, and the like are to be taken.

In this exemplary embodiment, to address this problem, a wrapping detecting part 302*c* for detecting wrapping of the paper P around the fixing belt 61 or the pressure roller 62 on the basis of the calculated number of revolutions of the drive motor 90 is provided in the control device 10 of the image forming apparatus 1A.

The wrapping detecting part 302*c* is configured as part of the calculating unit 302A.

Hereinafter, the operation of the wrapping detecting part 302*c* will be explained in detail with reference to FIGS. 10 and 11.

Figure 10:
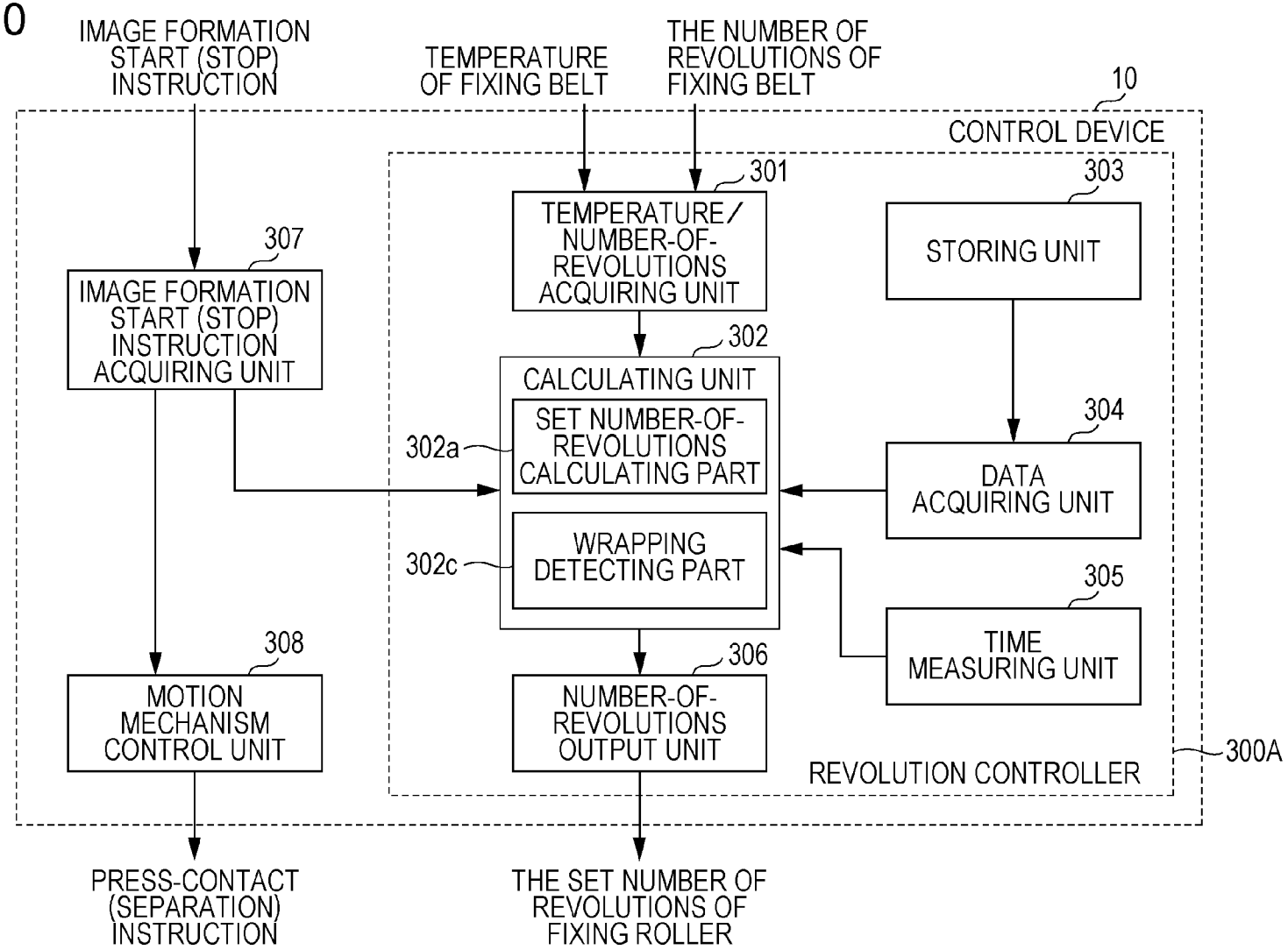
FIG. 10 is a block diagram for explaining a revolution controller including a wrapping detecting part of an image forming apparatus according to a second exemplary embodiment.

FIG. 10 is a block diagram for explaining the revolution controller 300A including the wrapping detecting part 302*c*.

Figure 11:
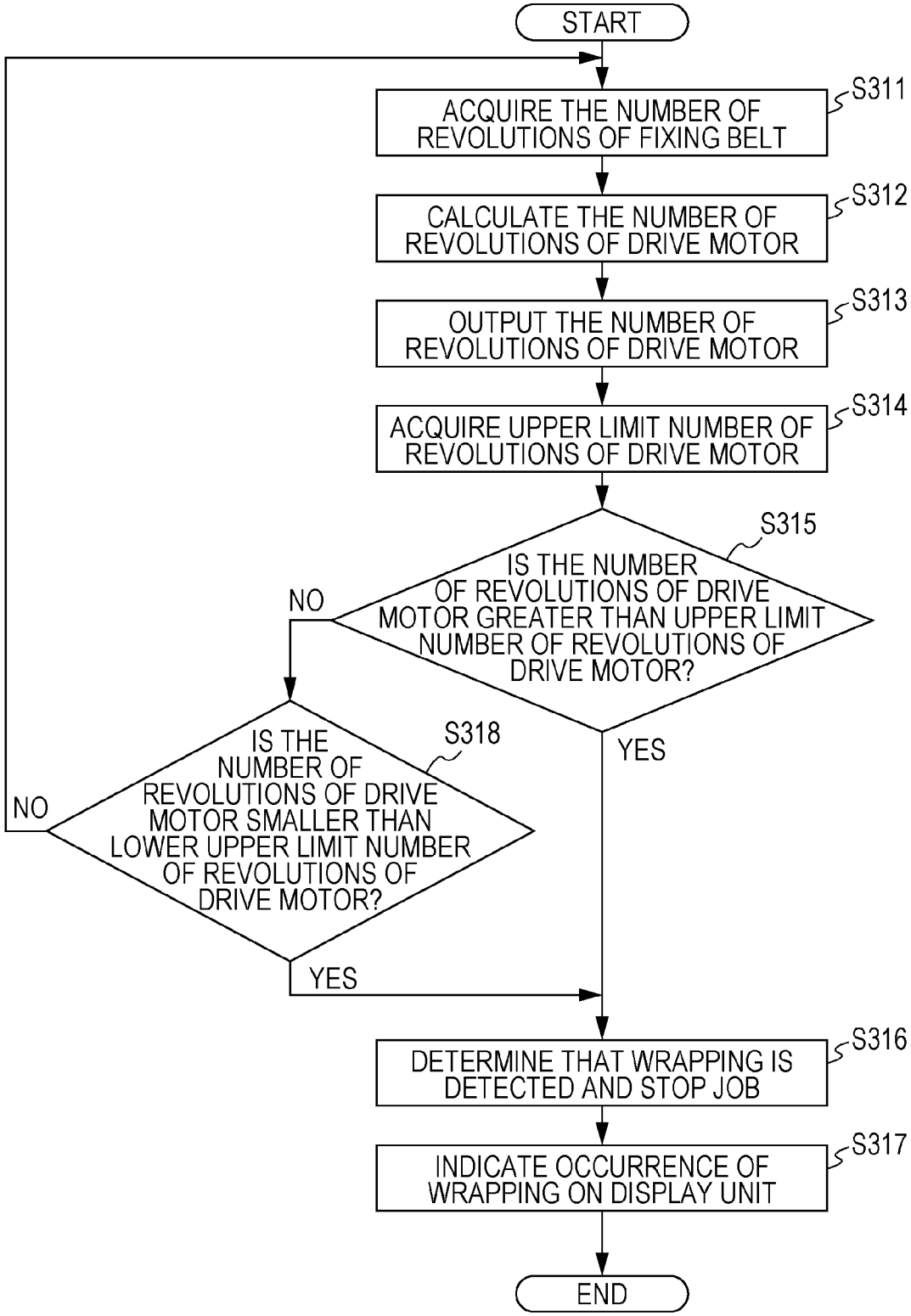
FIG. 11 is a flowchart for explaining the flow of a process performed by the revolution controller including the wrapping detecting part of the image forming apparatus according to the second exemplary embodiment.

FIG. 11 is a flowchart for explaining the flow of the process performed by the revolution controller 300A including the wrapping detecting part 302*c*.

In the case where the paper P is fully wrapped around the fixing belt 61, the outer diameter of the fixing belt 61 increases by the thickness of the paper wrapped around the fixing belt 61. The fixing belt 61 performs slave rotation by receiving drive force from the pressure roller 62. Thus, in the case where the pressure roller 62 is driven at the set number of revolutions for a normal job, since the apparent peripheral length of the fixing belt 61 increases, the revolution sensor 107 outputs, as the number of revolutions of the fixing belt 61, a number of revolutions smaller than normal times.

Furthermore, when the paper P is fully wrapped around the pressure roller 62, the outer diameter of the pressure roller 62 increases as the thickness of the paper wrapped around the pressure roller 62. The fixing belt 61 performs slave rotation by receiving drive force from the pressure roller 62. Thus, in the case where the pressure roller 62 is driven at the set number of revolutions for a normal job, since the outer diameter of the pressure roller 62 increases by the thickness of the paper wrapped around the pressure roller 62, the revolution sensor 107 outputs, as the number of revolutions of the fixing belt 61, a number of revolutions greater than normal times.

The temperature/number-of-revolutions acquiring unit 301 of the revolution controller 300A acquires the current number of revolutions (Rb1) of the fixing belt 61 as a signal of the revolution sensor 107 from the temperature/number-of-revolutions output unit 901 of the fixing device 60 (step S311), and the acquired current number of revolutions (Rb1) of the fixing belt 61 is stored into the storing unit 303.

Then, the set number-of-revolutions calculating part 302*a* calculates, on the basis of the acquired current number of revolutions (Rb1) of the fixing belt 61, the number of revolutions (Rm1) of the drive motor 90 for controlling the number of revolutions of the fixing belt 61 to be a predetermined specific number of revolutions, and the calculated number of revolutions (Rm1) of the drive motor 90 is stored into the storing unit 303 (step S312).

The number of revolutions (Rm1) of the drive motor 90 is transmitted via the set number-of-revolutions acquiring unit 902 to the motor driver 910, and the motor driver 910 controls the revolution of the drive motor 90 (step S313).

The wrapping detecting part 302*c* acquires, via the data acquiring unit 304, the predetermined upper limit number of revolutions (Rmu) of the drive motor 90 and the predetermined lower limit number of revolutions (Rml) of the drive motor 90 for a normal job stored in the storing unit 303 (step S314), and the number of revolutions (Rm1) of the drive motor 90 set in step S313 is compared with each of the upper limit number of revolutions (Rmu) and the lower limit number of revolutions (Rml) acquired in step S314 (step S315).

When the set number of revolutions (Rm1) of the drive motor 90 is greater than the predetermined upper limit number of revolutions (Rmu) of the drive motor 90 for a normal job (YES in step S315), the image forming apparatus 1A is stopped (step S316). Then, a warning is issued to the user of the image forming apparatus 1A (step S317). For example, a message representing the warning is indicated on an operation display unit (not illustrated in FIG. 1) of the image forming apparatus 1A.

When the set number of revolutions (Rm1) of the drive motor 90 is smaller than or equal to the predetermined upper limit number of revolutions (Rmu) of the drive motor 90 for a normal job (NO in step S315), the wrapping detecting part 302*c* compares the predetermined lower limit number of revolutions (Rml) of the drive motor 90 for a normal job acquired via the data acquiring unit 304 with the number of revolutions (Rm1) of the drive motor 90 set in step S313 (step S318).

When the set number of revolutions (Rm1) of the drive motor 90 is smaller than the predetermined lower limit number of revolutions (Rml) of the drive motor 90 for a normal job (YES in step S318), the image forming apparatus 1A is stopped. Then, a warning is issued to the user of the image forming apparatus 1A (step S316).

When the set number of revolutions (Rm1) of the drive motor 90 is equal to or greater than the predetermined lower limit number of revolutions (Rml) of the drive motor 90 for a normal job (NO in step S318), it is determined that a normal job is being performed. Then, the fixing operation continues to be performed until the print job is completed.

By the control described above, the image forming apparatus 1A is capable of detecting wrapping of paper without providing a dedicated sensor for detecting wrapping of paper around the fixing belt 61 or the pressure roller 62.

Variation of Second Exemplary Embodiment

In the second exemplary embodiment described above, wrapping of paper is detected by comparing the set number of revolutions (Rml) of the drive motor 90 with the predetermined upper limit number of revolutions (Rmu) or the predetermined lower limit number of revolutions (Rml) of the drive motor 90 for a normal job. However, detection of wrapping may be performed in a different way.

When the paper P is wrapped around the fixing belt 61 or the pressure roller 62, since the apparent outer diameter of the fixing belt 61 or the fixing belt 61 drastically increases, the number of revolutions of the drive motor 90 calculated by the set number-of-revolutions calculating part 302*a* of the calculating unit 302A drastically decreases. Thus, for example, in the case where the decrease rate of the number of revolutions of the drive motor 90 for a certain sampling period reaches a specific value or more, detection of wrapping may be performed by determining that the paper P is wrapped around the fixing belt 61 or the pressure roller 62.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a toner image forming unit that forms a toner image, a fixing device including a fixing member that fixes toner to a recording medium, a pressure member that conveys the recording medium in such a manner that the recoding medium is sandwiched between the fixing member and the pressure member, a driving unit that rotates the pressure member to allow the fixing member to perform slave rotation, and a number-of-revolutions sensing unit that senses the number of revolutions of the fixing member;

a number-of-revolutions determining unit that determines, based on the number of revolutions of the fixing member sensed by the number-of-revolutions sensing unit, the number of revolutions of the driving unit;

a stopping unit that stops the driving unit when the number of revolutions determined by the number-of-revolutions determining unit is not equal to a specific number of revolutions, a number-of-revolutions decrease rate calculating unit that calculates, based on a first number of revolutions of the driving unit determined by the number-of-revolutions determining unit and a second number of revolutions of the driving unit determined after a specific time has passed, the decrease rate of the number of revolutions of the driving unit; and a separating unit that separates the pressure member from the fixing member when the decrease rate of the number of revolutions calculated by the number-of-revolutions decrease rate calculating unit is greater than a specific decrease rate of the number of revolutions of the driving unit.

2. An image forming apparatus comprising:

a toner image forming unit that forms a toner image, a fixing device including, a fixing member that fixes toner to a recording medium, a pressure member that conveys the recording medium in such a manner that the recoding medium is sandwiched between the fixing member and the pressure member, a driving unit that rotates the pressure member to allow the fixing member to perform slave rotation, and a number-of-revolutions sensing unit that senses the number of revolutions of the fixing member;

a number-of-revolutions determining unit that determines, based on the number of revolutions of the fixing member sensed by the number-of-revolutions sensing unit, the number of revolutions of the driving unit;

a number-of-revolutions decrease rate calculating unit that calculates, based on a first number of revolutions of the driving unit determined by the number-of-revolutions determining unit and a second number of revolutions of the driving unit determined after a specific time has passed, the decrease rate of the number of revolutions of the driving unit; and a separating unit that separates the pressure member from the fixing member when the decrease rate of the number of revolutions calculated by the number-of-revolutions decrease rate calculating unit is greater than a specific decrease rate of the number of revolutions of the driving unit.

3. The image forming apparatus according to claim 2, wherein the specific decrease rate of the number of revolutions of the driving unit is set corresponding to the outer diameter of the pressure member, the outer diameter being changed in accordance with heat history received by the pressure member.

4. A fixing device comprising:

a fixing member that includes a conductive layer and that fixes toner to a recording medium when the conductive layer is electromagnetically induction-heated;

a pressure member that conveys the recording medium in such a manner that the recording medium is sandwiched between the fixing member and the pressure member;

a magnetic field generating unit that faces the fixing member and that generates a magnetic field;

a driving unit that rotates the pressure member to allow the fixing member to perform slave rotation;

a number-of-revolutions sensing unit that senses the number of revolutions of the fixing member;

a moving unit that moves the pressure member so as to be separated from or be press-contacted with the fixing member;

an output unit that outputs the number of revolutions of the fixing member sensed by the number-of-revolutions sensing unit; and an acquiring unit that receives the number of revolutions of the driving unit set based on the number of revolutions of the fixing member output from the output unit, a number-of-revolutions decrease rate calculating unit that calculates, based on a first number of revolutions of the driving unit determined by the number-of-revolutions sensing unit and a second number of revolutions of the driving unit determined after a specific time has passed, the decrease rate of the number of revolutions of the driving unit; and a separating unit that separates the pressure member from the fixing member when the decrease rate of the number of revolutions calculated by the number-of-revolutions decrease rate calculating unit is greater than a specific decrease rate of the number of revolutions of the driving unit.

5. An image forming method comprising:

forming a toner image;

fixing toner to a recording medium;

conveying the recording medium;

rotating a pressure member to allow a fixing member to perform slave rotation;

sensing the number of revolutions of the fixing member;

determining, based on the sensed number of revolutions of the fixing member, the number of revolutions of a driving unit; and stopping the driving unit when the determined number of revolutions is not equal to a specific number of revolutions;

determining a number-of-revolutions decrease rate based on a first number of revolutions of the driving unit and a second number of revolutions of the driving unit determined after a specific time has passed, the decrease rate of the number of revolutions of the driving unit; and separating the pressure member from the fixing member when the decrease rate of the number of revolutions is greater than a specific decrease rate of the number of revolutions of the driving unit.

* * * * *